US011820552B2

(12) United States Patent
Guerry et al.

(10) Patent No.: US 11,820,552 B2
(45) Date of Patent: Nov. 21, 2023

(54) CONTAINERS FOR OIL BOTTLES OR THE LIKE

(71) Applicant: Rehrig Pacific Company, Los Angeles, CA (US)

(72) Inventors: Brian Robert Guerry, Huntington Beach, CA (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 17/003,873

(22) Filed: Aug. 26, 2020

(65) Prior Publication Data

US 2021/0070498 A1 Mar. 11, 2021

Related U.S. Application Data

(60) Provisional application No. 62/972,017, filed on Feb. 9, 2020, provisional application No. 62/916,161, filed
(Continued)

(51) Int. Cl.
*B65D 21/02* (2006.01)
*B65D 6/18* (2006.01)
*B65D 21/06* (2006.01)

(52) U.S. Cl.
CPC ..... *B65D 21/0233* (2013.01); *B65D 11/186* (2013.01); *B65D 21/0226* (2013.01);
(Continued)

(58) Field of Classification Search
CPC ..... B65D 21/0233; B65D 11/186; B65D 21/0226; B65D 21/062; B65D 2501/2407; B65D 2501/24101; B65D 2501/2435; B65D 2501/24439; B65D 2501/24707; B65D 21/04; B65D 21/041; B65D 21/043; B65D 2501/24713
(Continued)

(56) References Cited

U.S. PATENT DOCUMENTS 189,378 A 4/1877 Niedringhaus
627,273 A 6/1899 Seibert
(Continued)

FOREIGN PATENT DOCUMENTS

CA 2069226 C 3/1993
DE 3511321 A1 10/1986
(Continued)

*Primary Examiner* — Rafael A Ortiz
*Assistant Examiner* — Sanjidul Islam
(74) *Attorney, Agent, or Firm* — Carlson, Gaskey & Olds, P.C.

(57) ABSTRACT

A collapsible container having a base, an upper frame, and a pair of opposed side walls pivotably connected to side edges of the upper frame. Each of the side walls including an upper panel hingeably connected to a lower panel. The lower panel is hingeably connected to the base. A pair of opposed end walls are pivotably connected to end edges of the upper frame. The end walls are pivotable between an upright position extending from the upper frame to the base between the side walls and a retracted position within the upper frame. A lid is pivotably secured to the upper frame. Other embodiments are also disclosed.

22 Claims, 39 Drawing Sheets

Related U.S. Application Data on Oct. 16, 2019, provisional application No. 62/891,898, filed on Aug. 26, 2019.

(52) U.S. Cl.
CPC .... *B65D 21/062* (2013.01); *B65D 2501/2407* (2013.01); *B65D 2501/2435* (2013.01); *B65D 2501/24101* (2013.01); *B65D 2501/24439* (2013.01); *B65D 2501/24707* (2013.01)

(58) Field of Classification Search
USPC ..... 220/6, 4.31; 206/515, 507, 139
See application file for complete search history.

(56) References Cited

U.S. PATENT DOCUMENTS 1,082,274 A 12/1913 Lapish
1,180,354 A 4/1916 White
1,219,969 A 3/1917 Lowe
1,378,614 A 5/1921 McLeod
1,785,360 A 12/1930 Payzant
2,029,746 A 2/1936 Tufts et al.
2,061,414 A 11/1936 Tufts et al.
2,134,875 A 11/1938 Henze
2,221,504 A 11/1940 Beasley et al.
2,512,522 A 6/1950 Denny
2,552,929 A 5/1951 Bodkin
2,553,607 A 5/1951 Rosenberg
2,609,120 A 9/1952 Williams
2,747,748 A 5/1956 Barefoot
2,777,627 A 1/1957 Crane
2,782,950 A 2/1957 Corr
2,850,204 A 9/1958 Rehrig
RE25,050 E 10/1961 Hamilton
3,186,585 A 6/1965 Denny
3,220,603 A 11/1965 Bromley
3,323,673 A 6/1967 Cowan
3,360,180 A 12/1967 Venturi
3,374,915 A 3/1968 Verhein et al.
3,480,115 A 11/1969 Lallemant
3,659,743 A * 5/1972 Box ..... B65D 21/0201 206/506
3,685,718 A 8/1972 Chidgey
3,940,018 A 2/1976 Scholle
3,951,365 A 4/1976 Maeda
3,982,650 A 9/1976 Ichihara
3,986,628 A * 10/1976 Prodel ..... B65D 71/0051 206/427
4,049,113 A 9/1977 Joyce et al.
4,090,633 A 3/1978 Trubiano
4,093,071 A 6/1978 Stahl
4,106,623 A 8/1978 Carroll et al.
4,109,791 A 8/1978 Clipson et al.
4,176,747 A 12/1979 Aho
4,214,669 A 7/1980 McQuiston
4,241,831 A 12/1980 Locatelli
4,247,004 A 1/1981 Bird
4,293,069 A 10/1981 Partain
4,391,369 A 7/1983 Stahl et al.
4,423,813 A 1/1984 Kreeger et al.
4,466,541 A 8/1984 Tabler et al.
4,505,422 A 3/1985 Vossen
4,508,237 A 4/1985 Kreeger et al.
4,573,577 A * 3/1986 Miller ..... B65D 21/062 206/506
4,579,220 A 4/1986 Brundage
RE32,223 E 8/1986 Kreeger et al.
4,624,381 A 11/1986 Friedrich
4,643,310 A * 2/1987 Deaton ..... B65D 21/045 206/506
4,735,331 A 4/1988 Keenan et al.
4,759,451 A 7/1988 Apps
4,770,300 A 9/1988 Klein
4,773,533 A 9/1988 Greene
4,848,578 A 7/1989 Schafer
4,863,062 A 9/1989 Holliday
4,905,833 A 3/1990 Kreeger et al.
4,946,093 A 8/1990 Moorman
4,947,992 A 8/1990 Schafer
4,982,844 A 1/1991 Madan et al.
5,083,666 A 1/1992 Lam
5,415,293 A 5/1995 Ackermann et al.
5,445,425 A 8/1995 Lyver
5,469,986 A 11/1995 Jang
D367,200 S 2/1996 Brown
5,494,163 A 2/1996 Apps
5,609,254 A 3/1997 Loftus et al.
5,617,953 A 4/1997 Cope
D381,203 S 7/1997 Ackermann et al.
D382,404 S 8/1997 Cope
5,752,602 A 5/1998 Ackermann et al.
5,772,033 A 6/1998 Loftus et al.
5,881,902 A 3/1999 Ackermann
5,924,572 A 7/1999 Cope
6,059,114 A 5/2000 Loftus
6,145,664 A 11/2000 Cope
D436,729 S 1/2001 Aiken
6,938,722 B2 9/2005 Sasaki et al.
7,014,043 B2 3/2006 Raghunathan et al.
7,017,745 B2 3/2006 Raghunathan
7,234,599 B2 6/2007 Hassell et al.
7,249,675 B2 7/2007 Hassell et al.
7,581,641 B2 9/2009 Hassell et al.
8,047,369 B2 * 11/2011 Stahl ..... B65D 21/0233 206/506
8,091,706 B2 1/2012 Koefelda
10,377,530 B2 8/2019 Baltz et al.
2002/0117420 A1 8/2002 McDade
2002/0179480 A1 12/2002 Raghunathan et al.
2003/0155366 A1 8/2003 Raghunathan
2003/0222081 A1 12/2003 Apps et al.
2003/0230510 A1 12/2003 Aiken et al.
2004/0245142 A1 12/2004 Raghunathan
2005/0224385 A1 10/2005 Hassell et al.
2005/0263423 A1 12/2005 Hassell et al.
2005/0263424 A1 * 12/2005 Hassell ..... B65D 21/062 206/506
2006/0065576 A1 3/2006 Broutin et al.
2006/0108372 A1 5/2006 Aiken et al.
2006/0231449 A1 10/2006 Hassell et al.
2008/0105583 A1 5/2008 Stahl
2012/0279890 A1 * 11/2012 Meers ..... B65D 21/062 206/506

FOREIGN PATENT DOCUMENTS

DE 3521894 A1 1/1987
DE 3540005 A1 1/1987
DE 4102082 A1 7/1992
DE 19506228 A1 9/1995
DE 20008537 U1 9/2000
DE 19939019 A1 2/2001
DE 20002537 U1 6/2001
DE 102018110442 A1 11/2019
EP 0299657 A1 1/1989
EP 0311174 A1 4/1989
EP 0368713 A1 5/1990
EP 0413884 A1 2/1991
EP 0508461 A1 10/1992
EP 0557002 A1 8/1993
EP 0697341 A1 2/1996
EP 0751074 A1 1/1997
EP 0786413 A1 7/1997
EP 0818394 A2 1/1998
EP 0841254 A1 5/1998
EP 0856469 A2 8/1998
EP 0926073 A1 6/1999
EP 0953509 A1 11/1999
EP 1170223 A2 1/2002
EP 1241105 A1 9/2002
EP 1609725 A1 12/2005
EP 1743844 A1 1/2007
EP 2194001 A1 6/2010

(56) References Cited

FOREIGN PATENT DOCUMENTS

| | | | | |
|---|---|---|---|---|
| ES | 2115462 | A1 | 6/1998 | |
| FR | 1040163 | A | 10/1953 | |
| FR | 2325565 | A1 | 4/1977 | |
| FR | 2627746 | A1 | 9/1989 | |
| FR | 2678585 | A1 | 1/1993 | |
| FR | 2701690 | A1 | 8/1994 | |
| FR | 2829111 | A1 | 3/2003 | |
| GB | 916356 | A | 1/1963 | |
| GB | 947404 | A | 1/1964 | |
| GB | 1335729 | A | 10/1973 | |
| GB | 2068338 | A | 8/1981 | |
| GB | 2090227 | A | 9/1982 | |
| GB | 2124588 | A | 2/1984 | |
| GB | 2129401 | A | 5/1984 | |
| GB | 2137167 | A | 10/1984 | |
| GB | 2141778 | A | 1/1985 | |
| GB | 2171980 | A | 9/1986 | |
| GB | 2174678 | A | 11/1986 | |
| GB | 2180821 | A | 4/1987 | |
| GB | 2209737 | A | 5/1989 | |
| GB | 2223481 | A | 4/1990 | |
| GB | 2245251 | A | 1/1992 | |
| GB | 2255076 | A | 10/1992 | |
| GB | 2257422 | A | 1/1993 | |
| GB | 2283728 | A | 5/1995 | |
| GB | 2287241 | A | 9/1995 | |
| GB | 2296009 | A | 6/1996 | |
| GB | 2313361 | A | 11/1997 | |
| GB | 2330131 | A | 4/1999 | |
| GB | 2330826 | A | 5/1999 | |
| GB | 2330868 | A | 5/1999 | |
| GB | 2333285 | A | 7/1999 | |
| GB | 2340482 | A | 2/2000 | |
| WO | WO-0009297 | A1 * | 2/2000 | ..... B65D 21/062 |

* cited by examiner

CONTAINERS FOR OIL BOTTLES OR THE LIKE

BACKGROUND

Some containers of liquid, such as bottles of oil, are delivered to stores in cardboard boxes. The bottles are then removed from the boxes and sold individually. The cardboard boxes are discarded. Also, the cardboard boxes can become damaged during shipping, especially if any of the bottles leak.

SUMMARY

A number of different reusable containers are disclosed that are particularly suited, although not exclusively, for delivering to stores containers of liquid, such as bottles of oil.

One embodiment provides a collapsible container having a base, an upper frame, and a pair of opposed side walls pivotably connected to side edges of the upper frame. Each of the side walls including an upper panel hingeably connected to a lower panel. The lower panel is hingeably connected to the base. A pair of opposed end walls are pivotably connected to end edges of the upper frame. The end walls are pivotable between an upright position extending from the upper frame to the base between the side walls and a retracted position within the upper frame. A lid is pivotably secured to the upper frame.

In another embodiment, a nestable container includes a base and a plurality of walls extending upward from the base. Each of the plurality of walls including an upper portion and a lower portion. The upper portion projects outwardly relative to the lower portion. At least one bail arm is pivotably mounted to the upper portion. The bail arm is pivotable between a deployed position configured to abut a shoulder of a bottle and a retracted position adjacent an interior surface of the upper portion.

A collapsible container includes a base. A pair of opposed walls are movable between an upright position and a collapsed position on the base. A bail arm is slidably and pivotably secured to at least one of the pair of opposed walls. The bail arm is movable between a retracted position and a deployed position. The bail arm extends across an interior of the container in the deployed position.

DETAILED DESCRIPTION

Several embodiments are disclosed of containers for holding smaller containers, such as plastic bottles, such as for holding oil.

Figure 1:
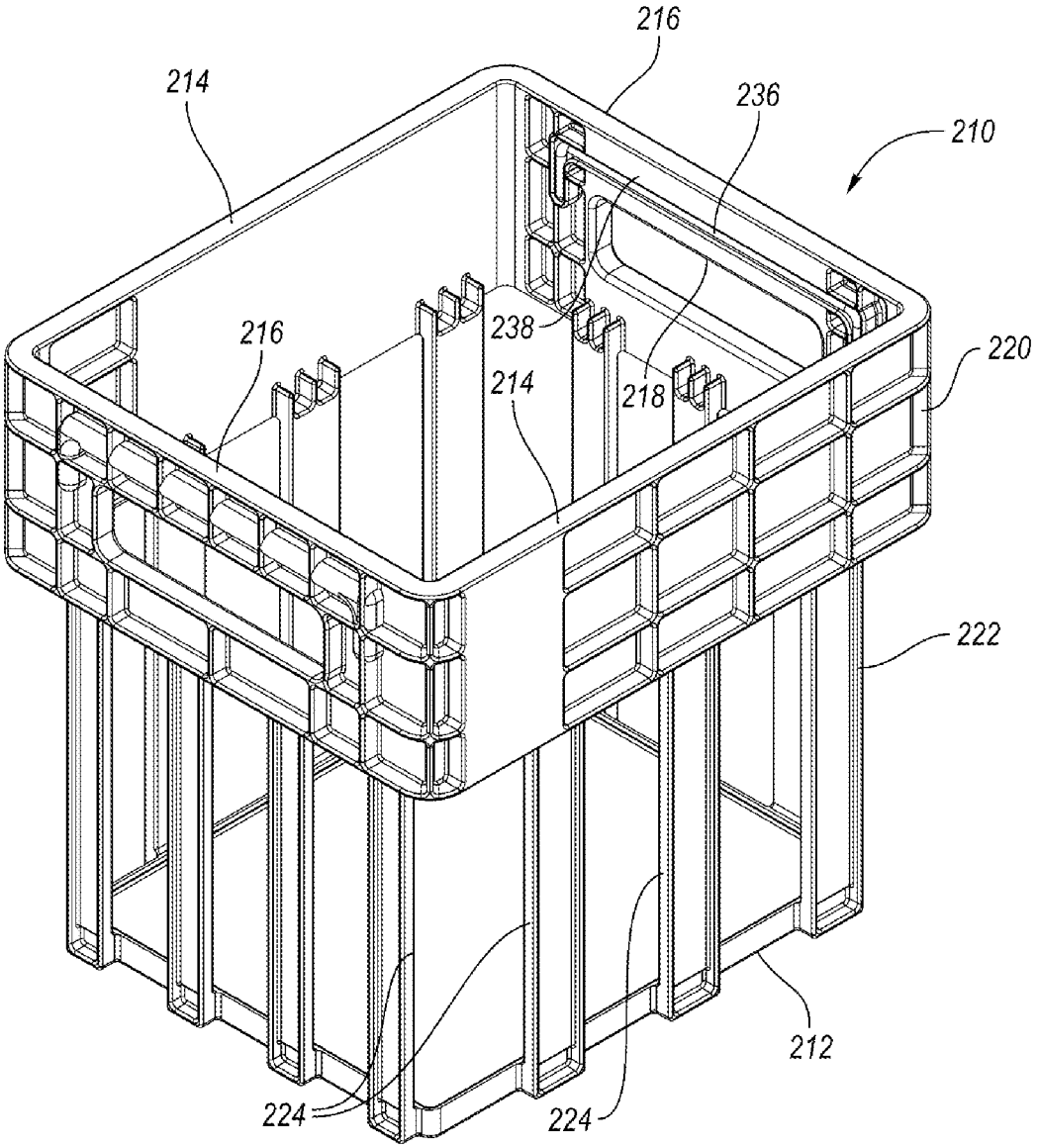
FIG. 1 shows a nestable container according to a first embodiment.

FIG. 1 shows one embodiment of a container 210. The container 210 includes a base 212, a pair of opposed side walls 214 and a pair of opposed end walls 216. Handle openings 218 are formed through an upper portion of each end wall 216.

Each of the side walls 214 and the end walls 216 includes a lower portion 222 and an upper portion 220. The lower 222 portion includes a plurality of spaced apart vertical slats 224. The upper portion 220 is disposed outward of the lower portion 222.

The container 210 has a pair of bail arms 236 that are pivotably mounted to the interior of the upper portion 220. The bail arms 236 are generally U-shaped, each having a pair of parallel arms pivotably connected at lower ends to the end wall 216 and a cross-beam connecting outer ends of the parallel arms. FIG. 1 shows the bail arms 236 in a retracted position (only one bail arm 236 is visible), received in a recess 238 above and partially around the handle opening 218.

Figure 2:
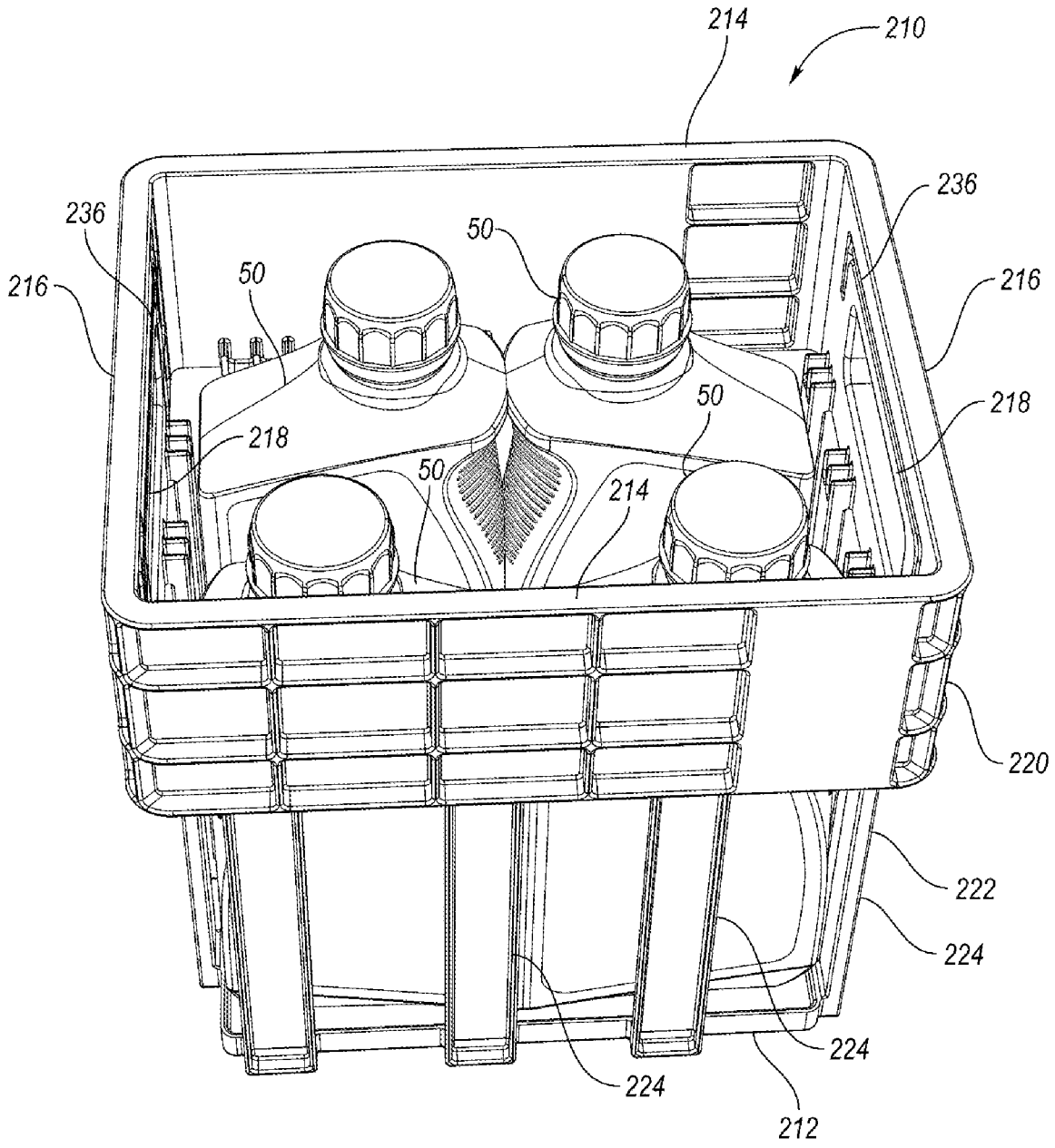
FIG. 2 is a perspective view of the container of FIG. 1 with four bottles received therein and with the bail arms retracted.

FIG. 2 shows a plurality (in this example, four) of bottles 50 received within the container 210. The bottles 50 are supported on the base 212 and abut the side walls 214 and end walls 216. In this illustrated example, the bottles 50 are 1-quart bottles 50.

Figure 3:
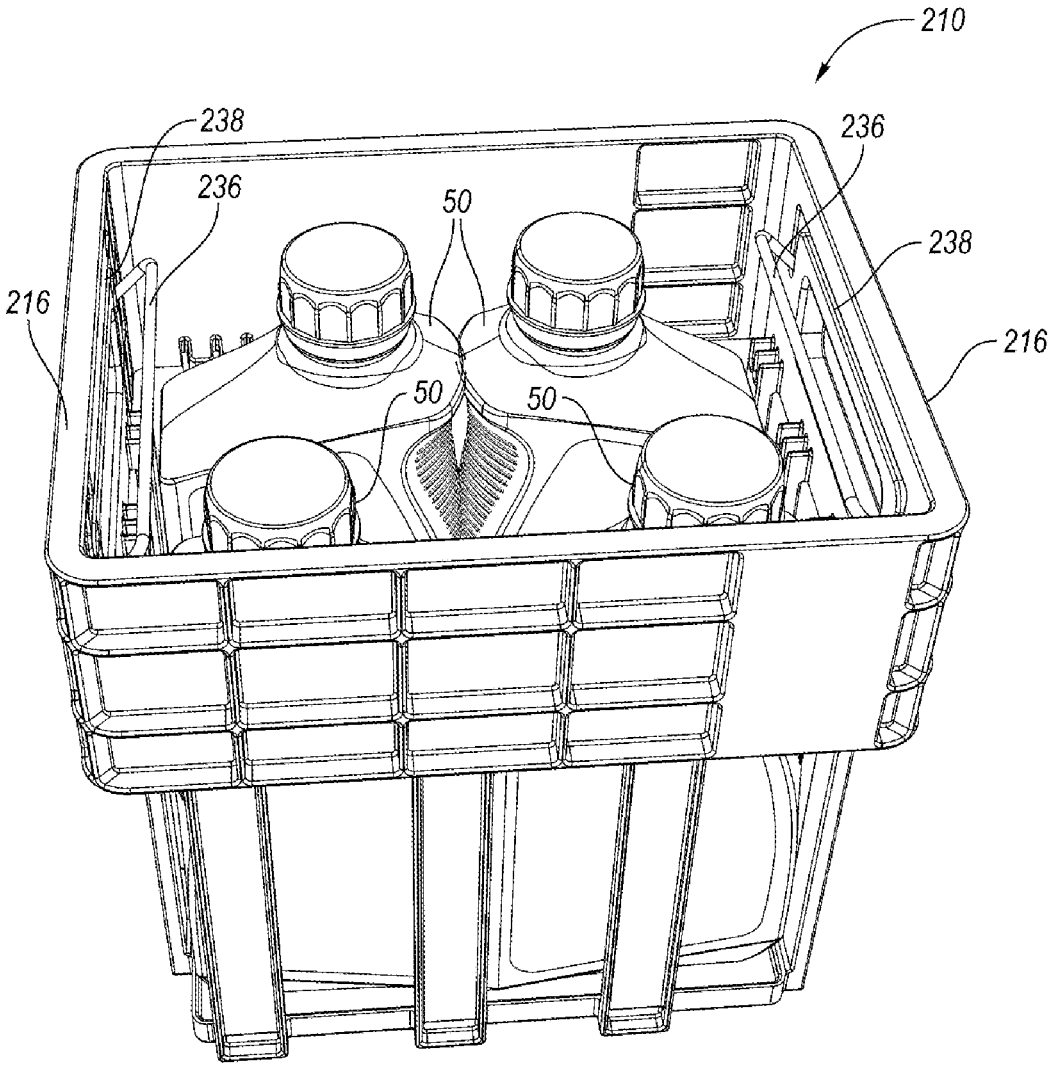
FIG. 3 shows the container and bottles of FIG. 2 with the bail arms being deployed.
Figure 4:
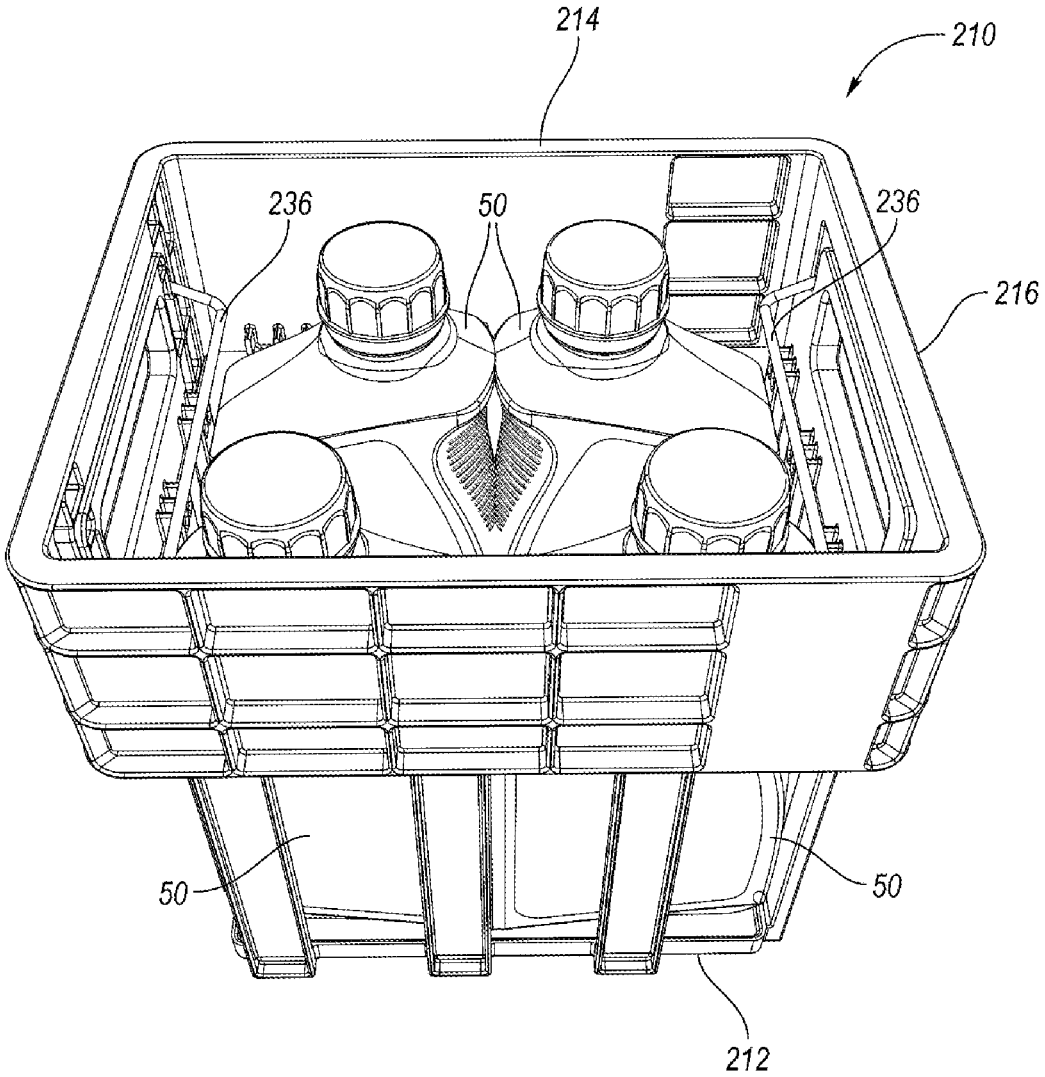
FIG. 4 shows the container and bottles of FIG. 2 with the bail arms deployed.
Figure 5:
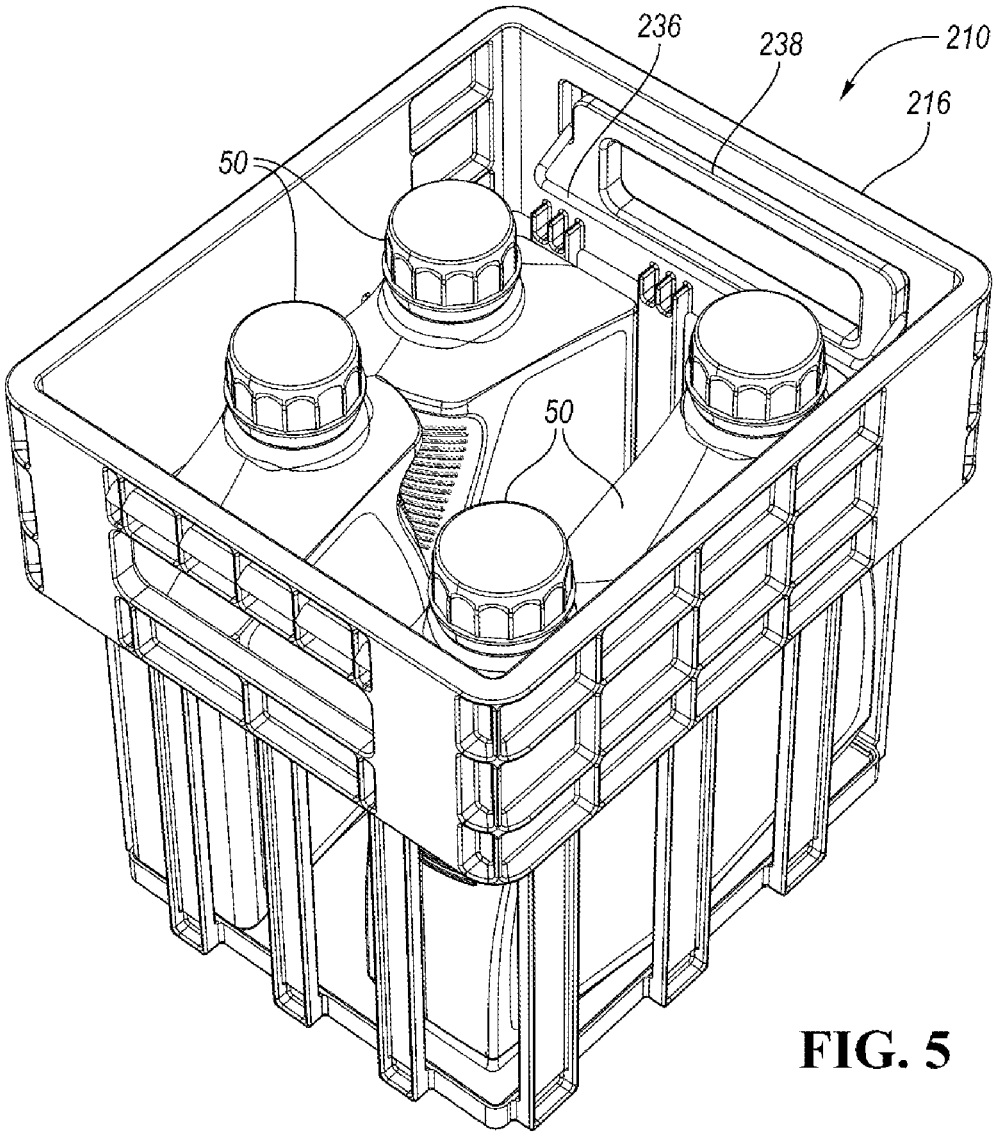
FIG. 5 is an upper perspective view of the container and bottles of FIG. 4.

After the bottles 50 are placed in the container 210, the bail arms 236 may be pivoted downward. FIG. 3 shows the bail arms 236 in-between their retracted position and their deployed position. The bail arms 236 are removed from their respective recesses 238 in the end walls 216 and pivoted downward toward the bottles 50 until they reach their fully-deployed position shown in FIGS. 4 and 5. In FIGS. 4 and 5, the bail arms 236 are pivoted downward to the deployed position in which they prevent removal of the bottles 50 from the container 210. Optionally, the bail arms 236 may contact the bottles 50, but as shown in FIGS. 4 and 5, this is not required. The bail arms 236 retain the bottles 50 in the container 210, even if the container 210 were tipped or knocked over.

Figure 6:
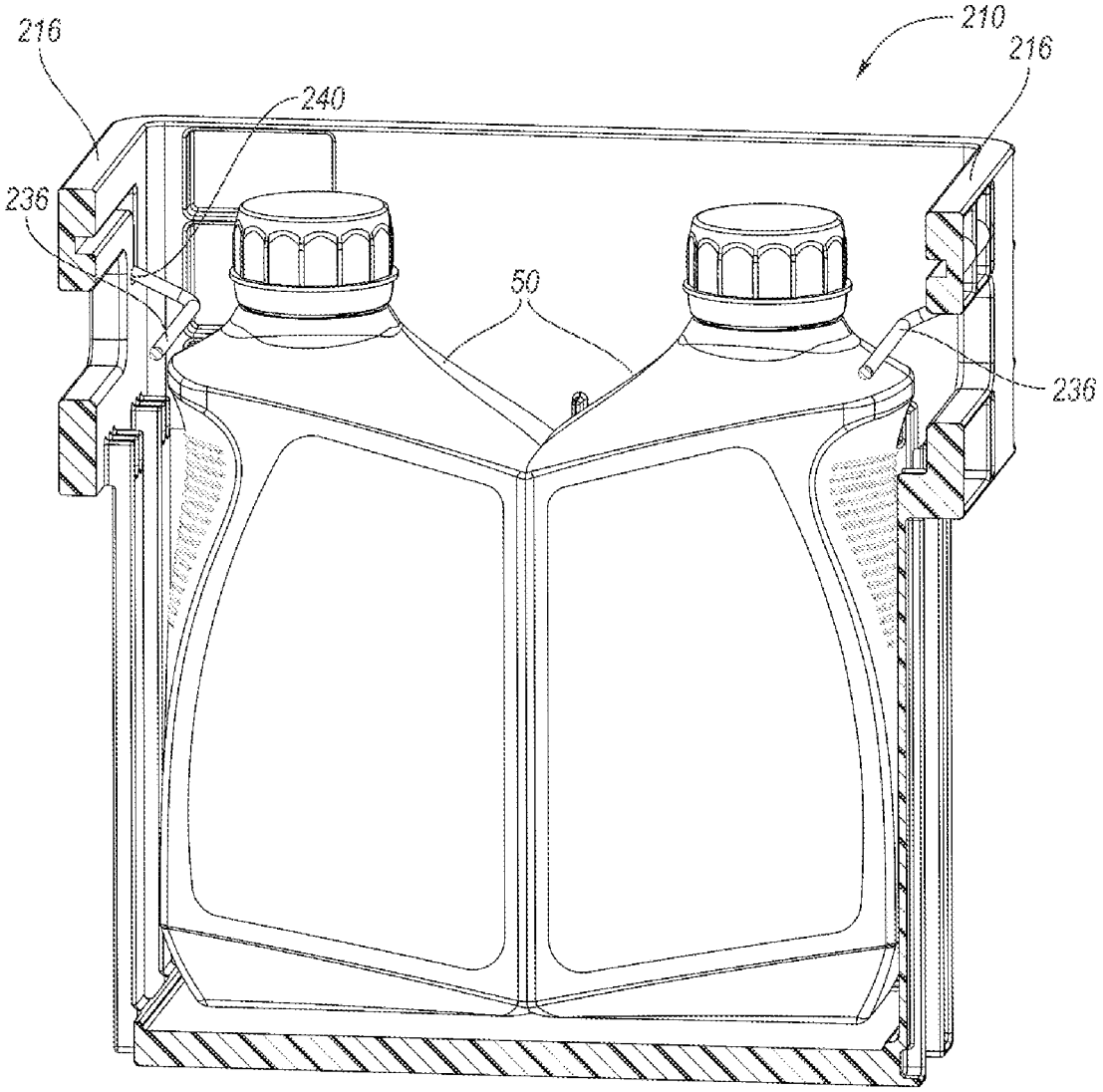
FIG. 6 is a section view through the container and bottles of FIG. 4.

The bail arms 236 can be pivoted down to a deployed position such that they extend into the interior of the container 210, as shown in FIGS. 4-6. In the example shown, the container 210 can hold four bottles 50, but any number of bottles could be accommodated depending on the size of the bottles. When deployed, the bail arms 236 may abut the shoulders of the bottles 50 to retain the bottles 50 in the container 210, or may be spaced away from the shoulders (or caps) of the bottles 50 as shown but still retain the bottles 50 in the container 210. Whether they abut the bottles 50 may depend on the orientation and shape of the bottles 50 in the container 210.

There are preferably detents 240 or manual locks that hold the bail arms 236 in the deployed position. If the container 210 is knocked over, the bail arms 236 retain the bottles 50 in the container 210. To remove the bottles 50, the bail arms 236 can be pivoted up back to the retracted position in the recess on the interior surface of the upper portion 220, as previously shown in FIG. 2.

Figure 7:
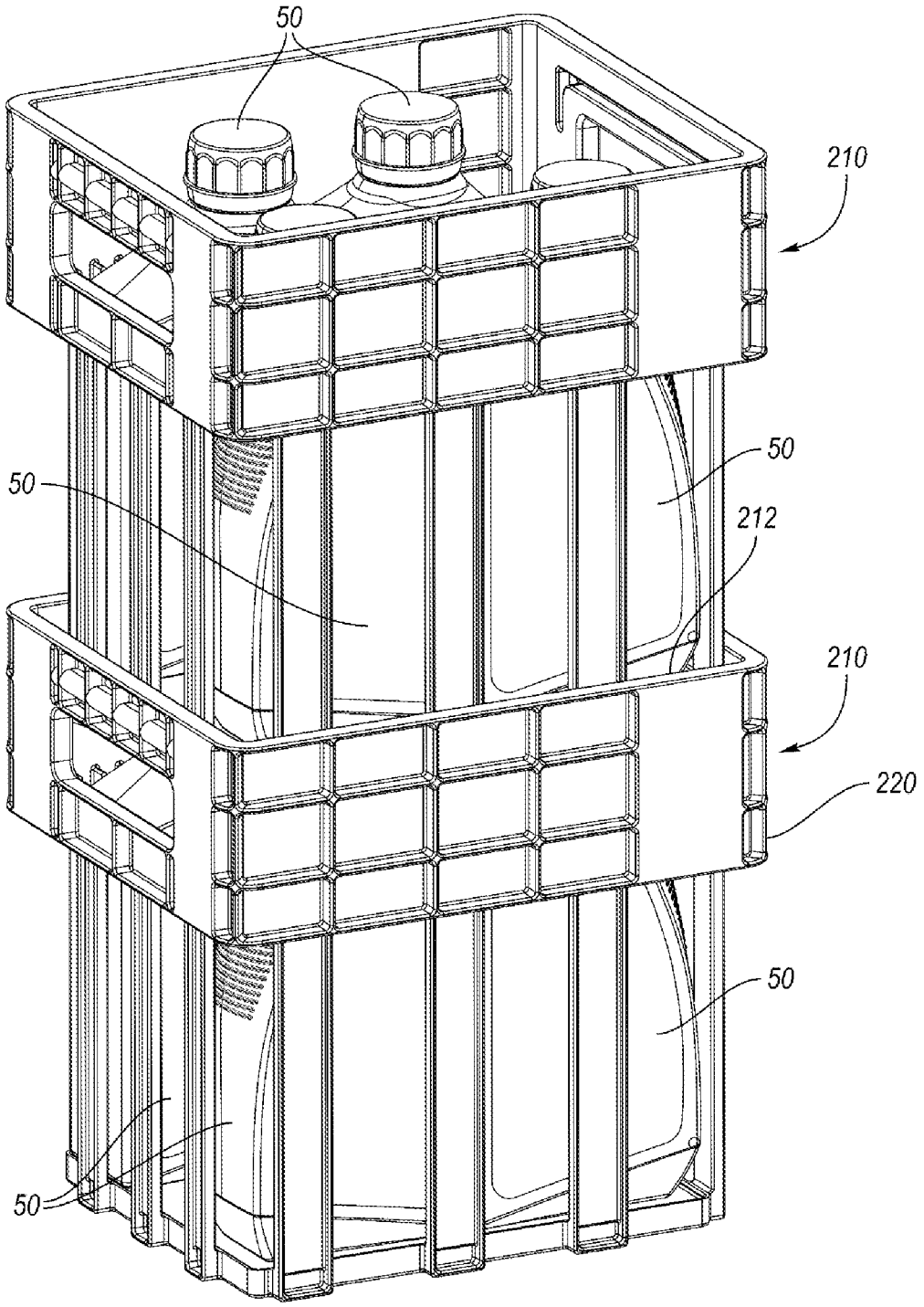
FIG. 7 shows an identical loaded container stacked on the container of FIG. 5.

As shown in FIG. 7, loaded containers 210 can be stacked on upon the other, with the base of the upper container 210 supported on the bottles 50 in the lower container 210. The base 212 of the upper container 210 is received partially within the upper portion 220 of the walls 214, 216 of the lower container 210 for stability.

Figure 8:
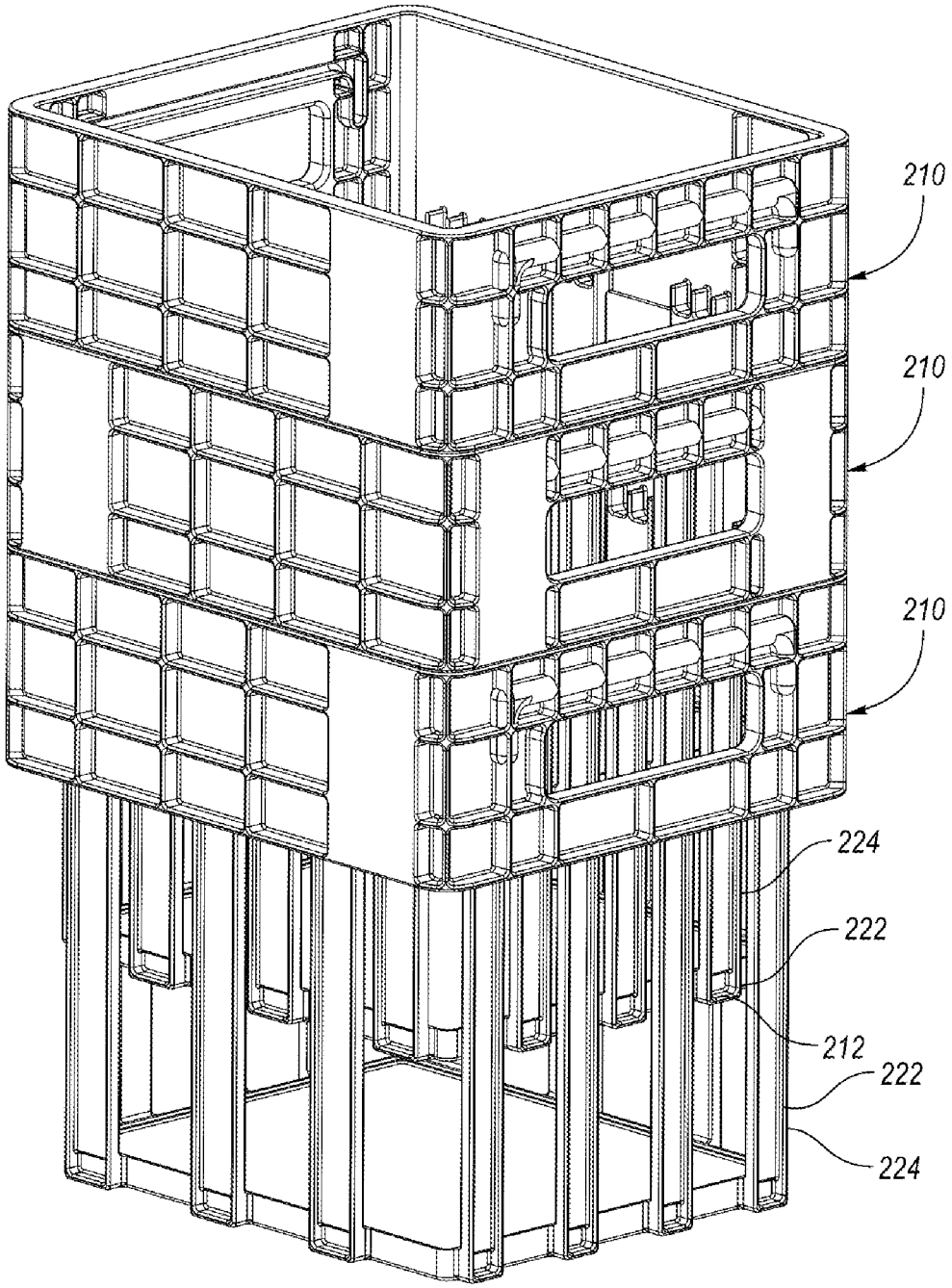
FIG. 8 shows three empty containers of the type shown in FIG. 1, nested together.

When empty, the containers 210 can be nested as shown in FIG. 8. As shown in FIG. 8, in the proper relative orientations, the lower portions 222 of the upper containers 210 fully nest into the upper portions 220 and lower portions 222 of the lower containers 210 (i.e. when the slats 224 are out of alignment). The base 212 of the upper container 210 is nested within the lower portion 222 of the lower container 210. The upper portions 220 of each upper container 210 rest on the upper portions 220 of each container 210 below. This significantly reduces the total volume of the empty containers 210 for efficient shipping and storage.

Figure 9:
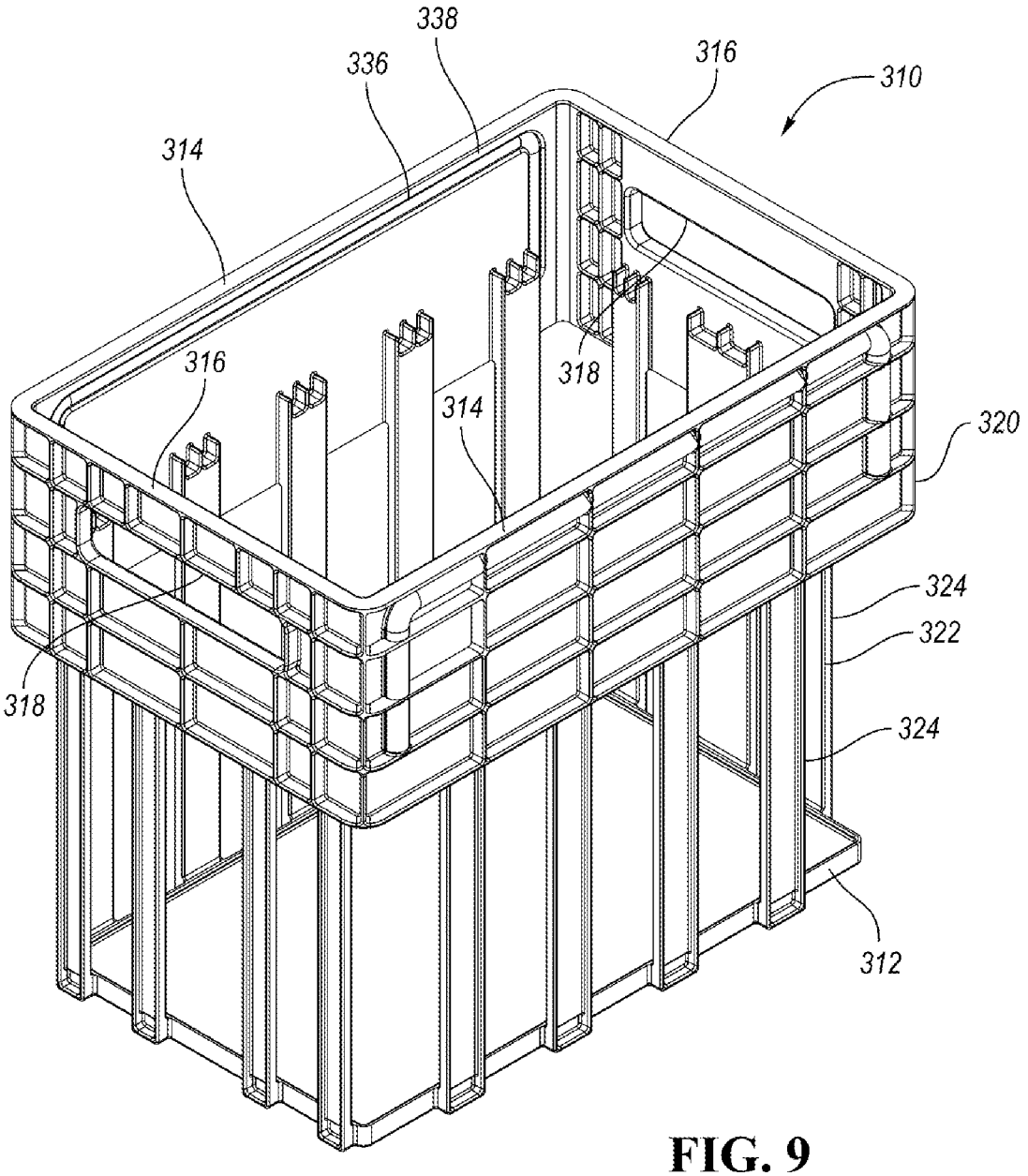
FIG. 9 shows a nestable container according to a second embodiment.

FIG. 9 shows an alternate embodiment in which a container 310 is similar to that of FIG. 1 but only has one bail arm 336 and only holds three larger bottles 50.

The container 310 includes a base 312, a pair of opposed side walls 314 and a pair of opposed end walls 316. Handle openings 318 are formed through an upper portion of each end wall 316.

Each of the side walls 314 and the end walls 316 includes a lower portion 322 and an upper portion 320. The lower 322 portion includes a plurality of spaced apart vertical slats 324. The upper portion 320 is disposed outward of the lower portion 322.

The container 310 has one bail arm 336 that is slidably and pivotably mounted to the interior of the upper portion 320 of one of the side walls 314. The bail arm 336 is generally U-shaped, having a pair of parallel arms pivotably connected at lower ends to the side wall 314 and a cross-beam connecting outer ends of the parallel arms. FIG. 9 shows the bail arm 336 in a retracted position, received in a recess 338 adjacent an upper edge of the side wall 314.

Figure 10:
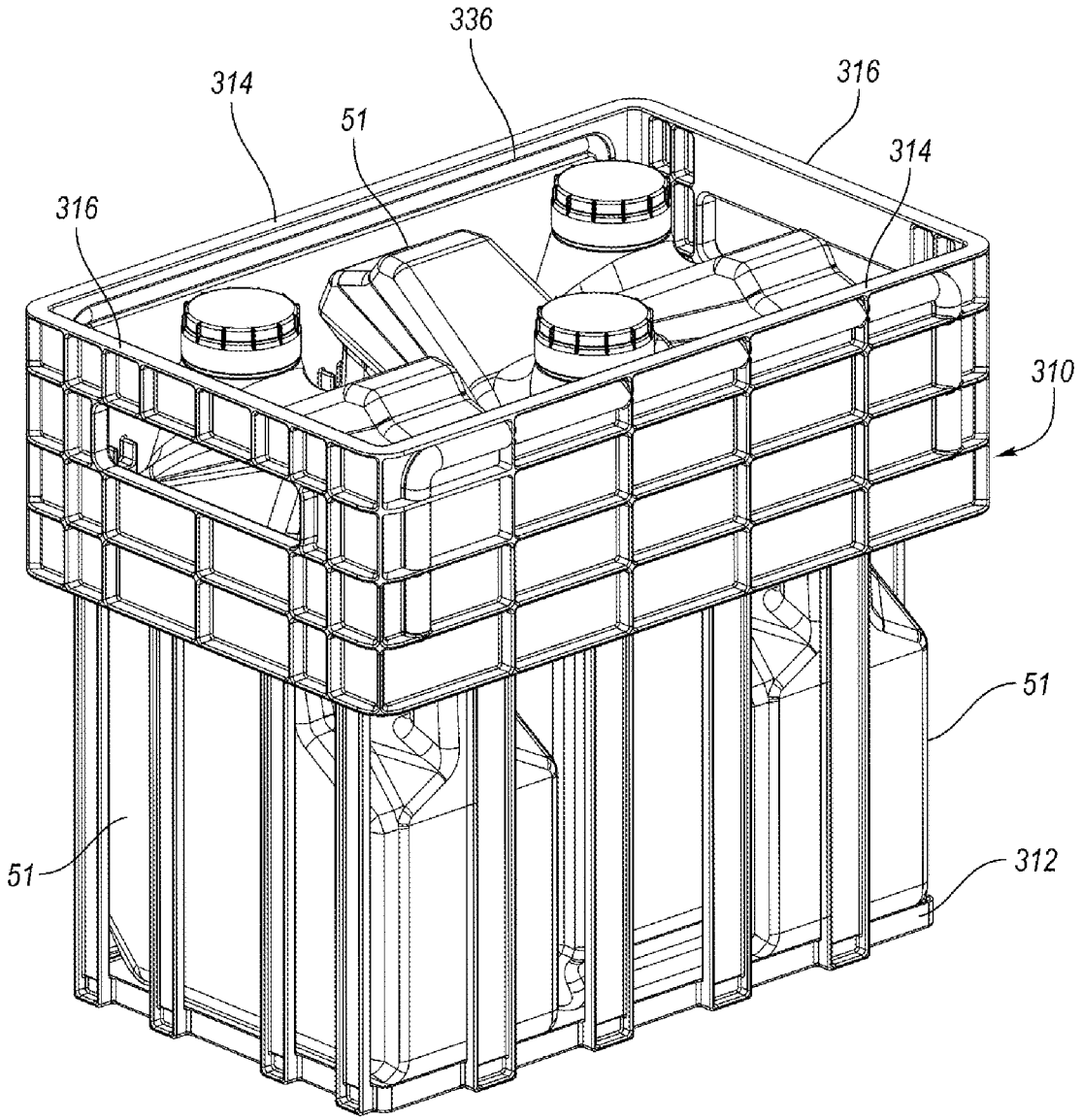
FIG. 10 is a perspective view of the container of FIG. 9 with three bottles received therein and with the bail arm retracted.

FIG. 10 shows the container 310 with three larger bottles 51 (e.g. 5-quart) received therein. The bottles 51 each abut both side walls 314. The bail arm 336 is in the retracted position in the side wall 314.

Figure 11:
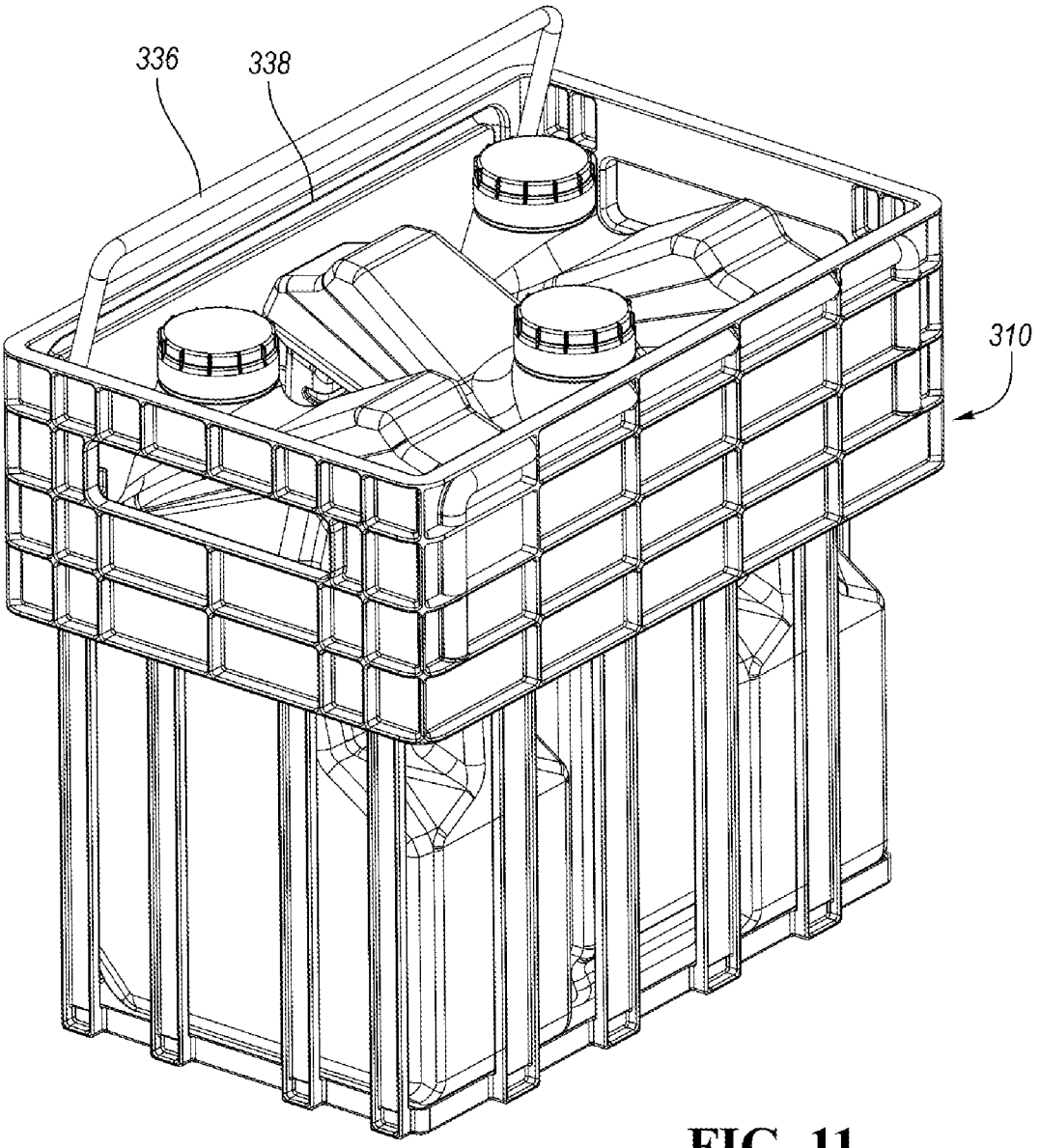
FIG. 11 shows the container and bottles of FIG. 9 with the bail arm being deployed.

FIG. 11 shows the bail arm 336 being moved from the retracted position toward the deployed position. The bail arm 336 has been removed from the recess 336, slid upward of the container 310, and pivoted inward slightly.

Figure 12:
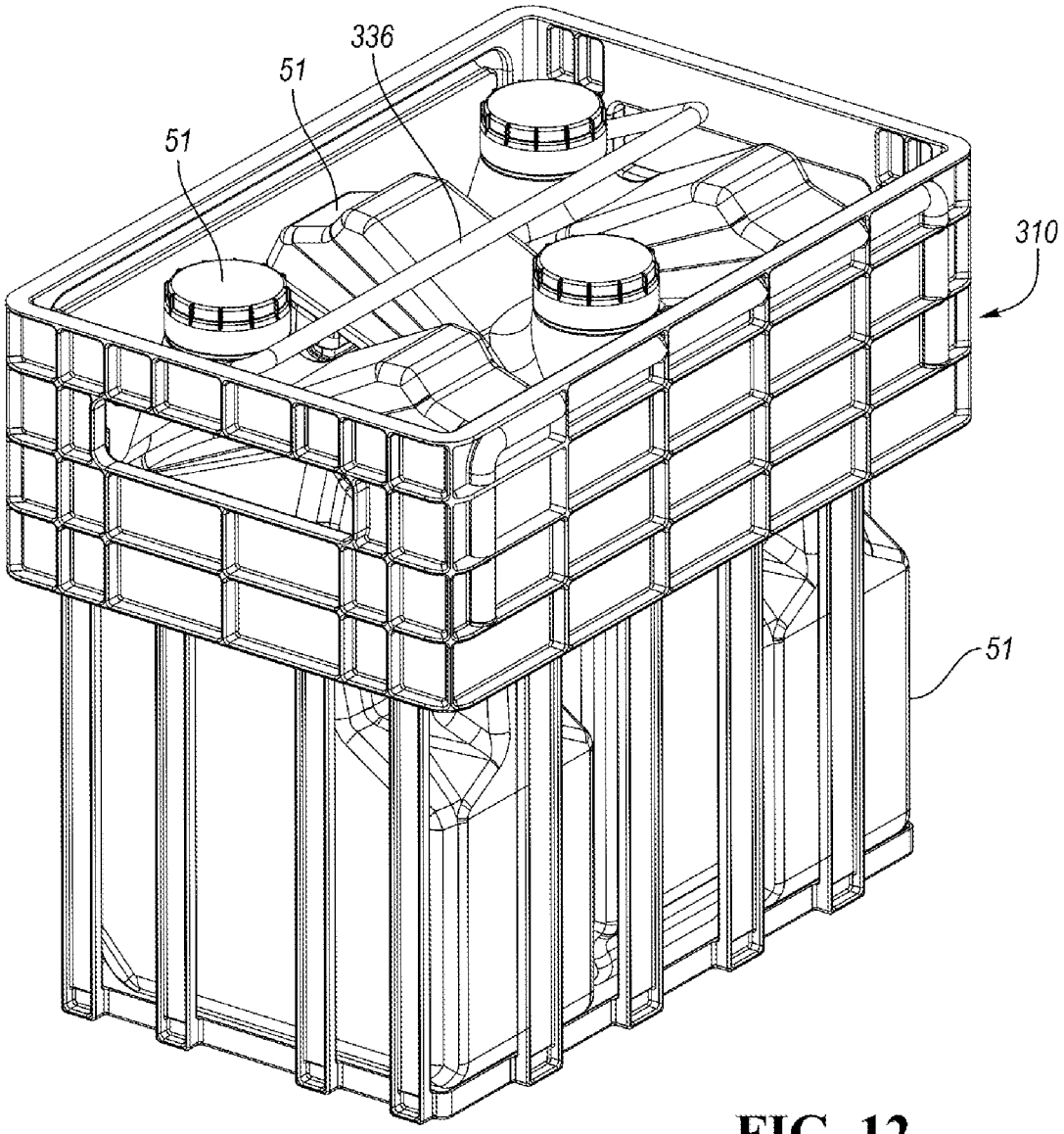
FIG. 12 shows the container and bottles of FIG. 9 with the bail arm deployed.

In FIG. 12, the bail arm 336 has been pivoted downward into the interior of the container 310 over the bottles 51. Again, the bail arm 336 may or may not contact the bottles 51, but will still retain the bottles 51 in the container 310. Again, locks or detents may secure the bail arm 336 in the deployed position.

Figure 13:
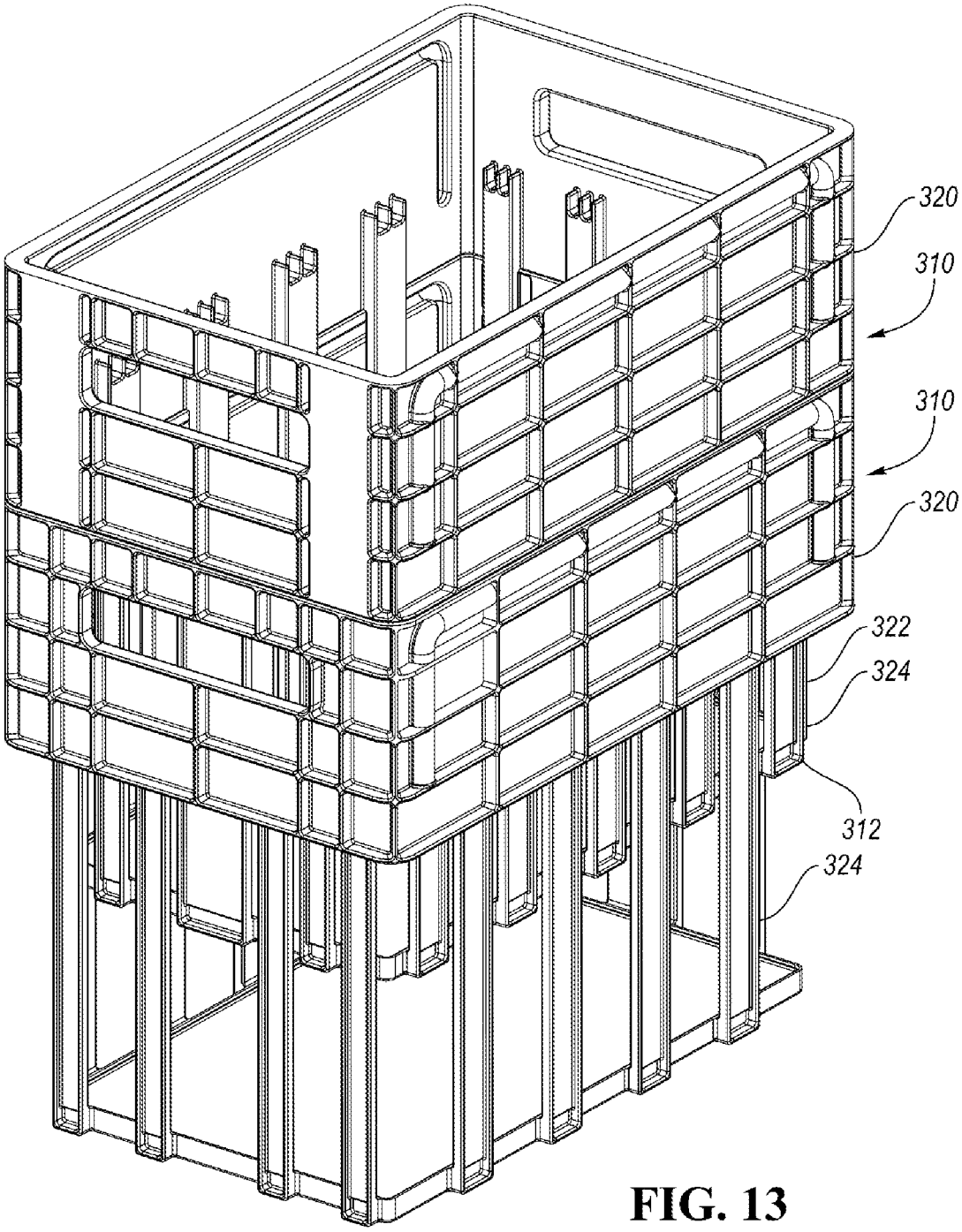
FIG. 13 shows the container of FIG. 9 with an identical empty container nested therein.
Figure 14:
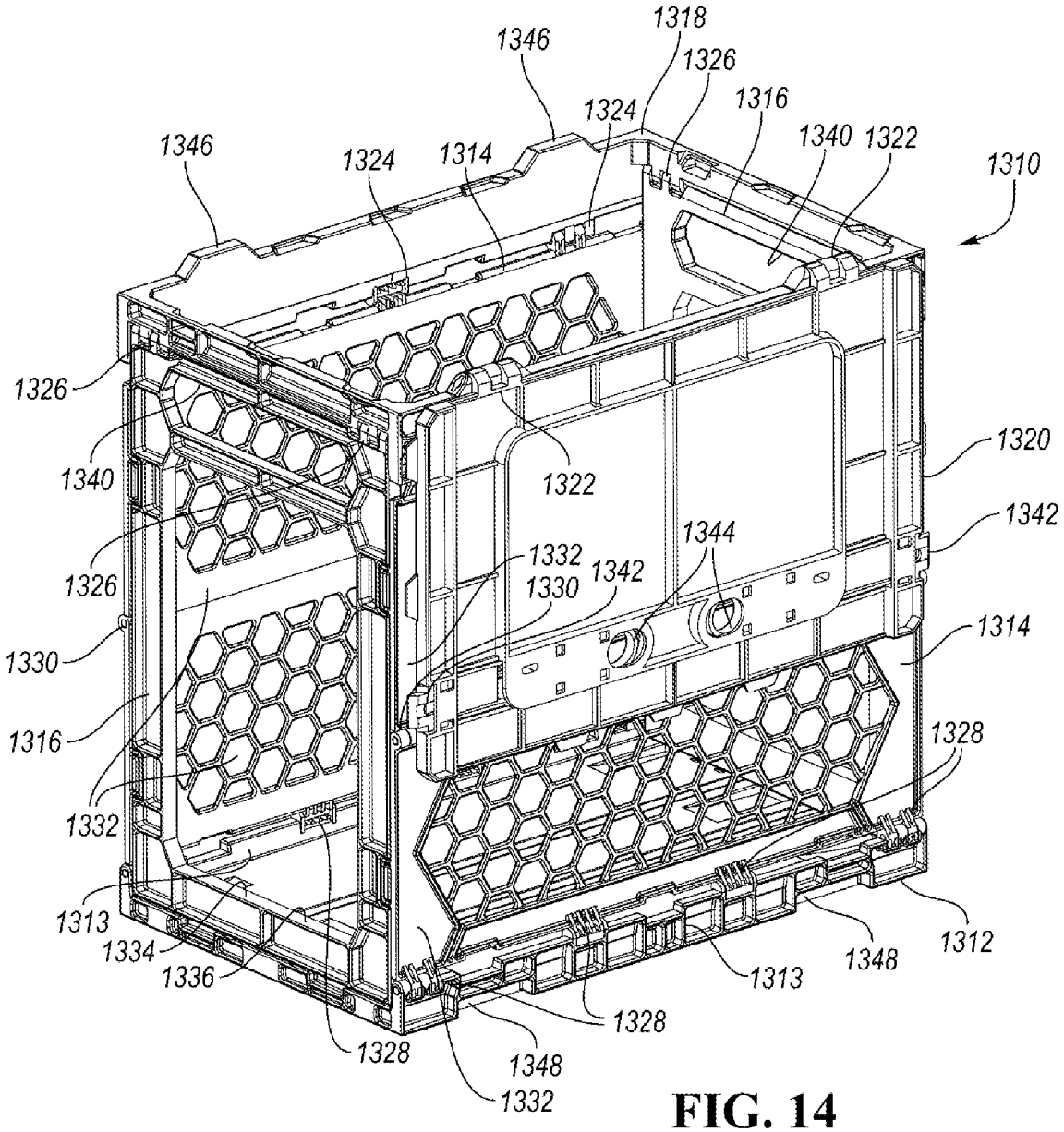
FIG. 14 is a perspective view of another embodiment of a collapsible container with the lid pivoted to the open position.

When empty, the containers 310 can be nested as shown in FIG. 13. As shown in FIG. 13, in the proper relative orientations, the lower portions 322 of the upper containers 310 fully nest into the upper portions 320 and lower portions 322 of the lower containers 310 (i.e. when the slats 324 are out of alignment). The base 312 of the upper container 310 is nested within the lower portion 322 of the lower container 310. The upper portions 320 of each upper container 310 rest on the upper portions 320 of each container 310 below. This significantly reduces the total volume of the empty containers 310 for efficient shipping and storage.

FIGS. 14 to 26 show a container 1310 according to another embodiment. The container 1310 includes a base 1312 having integrally molded upstanding side flanges 1313. Opposed side walls 1314 are pivotably connected to the side flanges 1313 by hinges 1328. Opposed end walls 1316 are between the side walls 1314 at opposite ends of the base 1312. The side walls 1314 and end walls 1316 are all pivotably connected to an upper frame 1318 by hinges 1324, 1326, respectively. A lid 1320 is pivotably connected to the upper frame 1318 by hinges 1322 projecting upwardly of the remainder of the upper frame 1318.

Each of the side walls 1314 includes upper and lower panels 1332 connected to one another by horizontal hinges 1330. The horizontal hinges 1330 only permit the panels 1332 to pivot inward, not outward. When the end walls 1316 are in the deployed position between the side walls 1314, the side walls 1314 cannot pivot inward and are locked in an upright position.

Each end wall 1316 includes a frame 1334 defining an outer perimeter of the end wall 1316 and a large opening 1336 within. A handle opening 1340 is formed at an upper end of each end wall 1316.

The lid 1320 has a pair of latch members 1342 projecting laterally from the lid 1320. The latch members 1342 are resiliently biased outward and can be selectively retracted by a user sliding handle loops 1344 toward one another.

Interlocking projections 1346 project upward from the side edge of the frame 1318 opposite the hinges 1322. The projections 1346 and hinges 1322 are aligned with and complementary to recesses 1348 at the outer perimeter of the base 1312.

Figure 15:
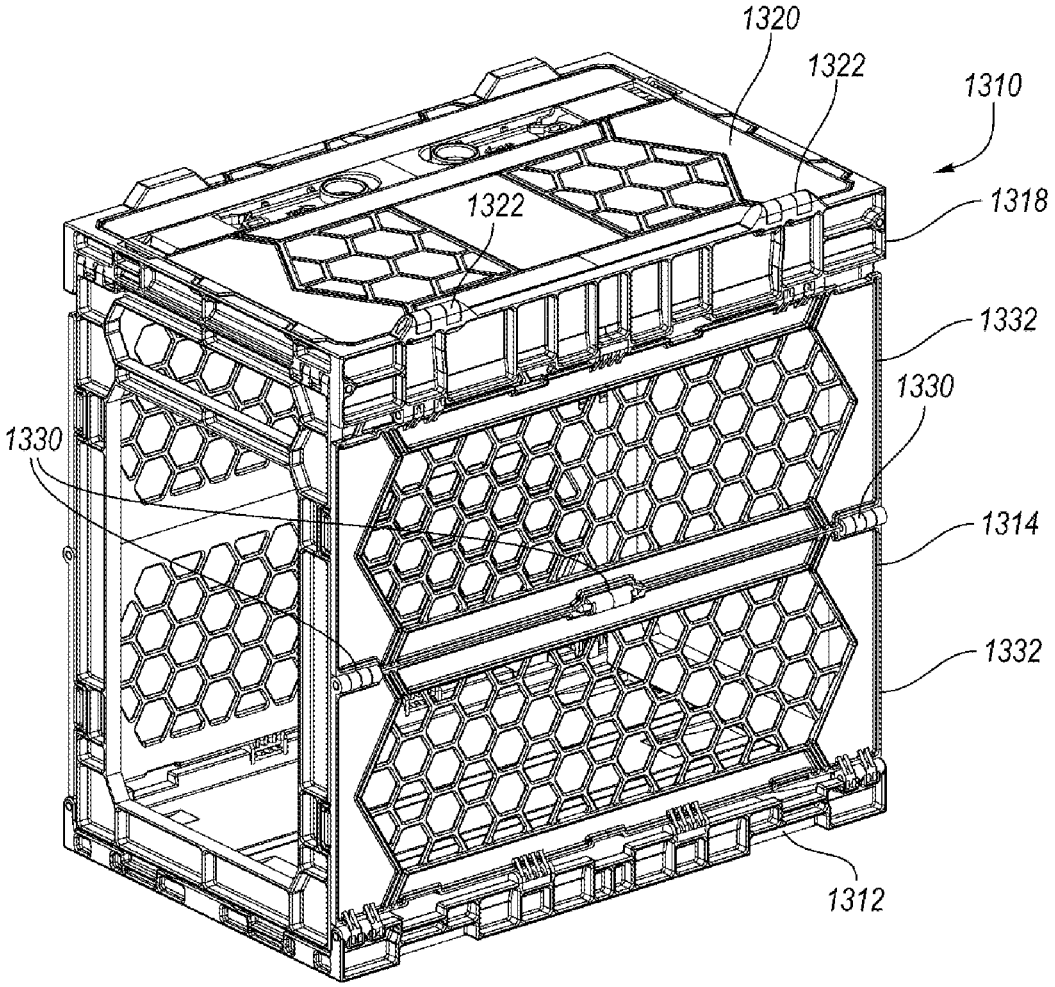
FIG. 15 shows the container of FIG. 14 with the lid closed.

FIG. 15 shows the container 1310 with the lid 1320 pivoted to the closed position. The latch members 1342 (not visible) are received in recesses in the inner perimeter of the frame 1318.

Figure 16:
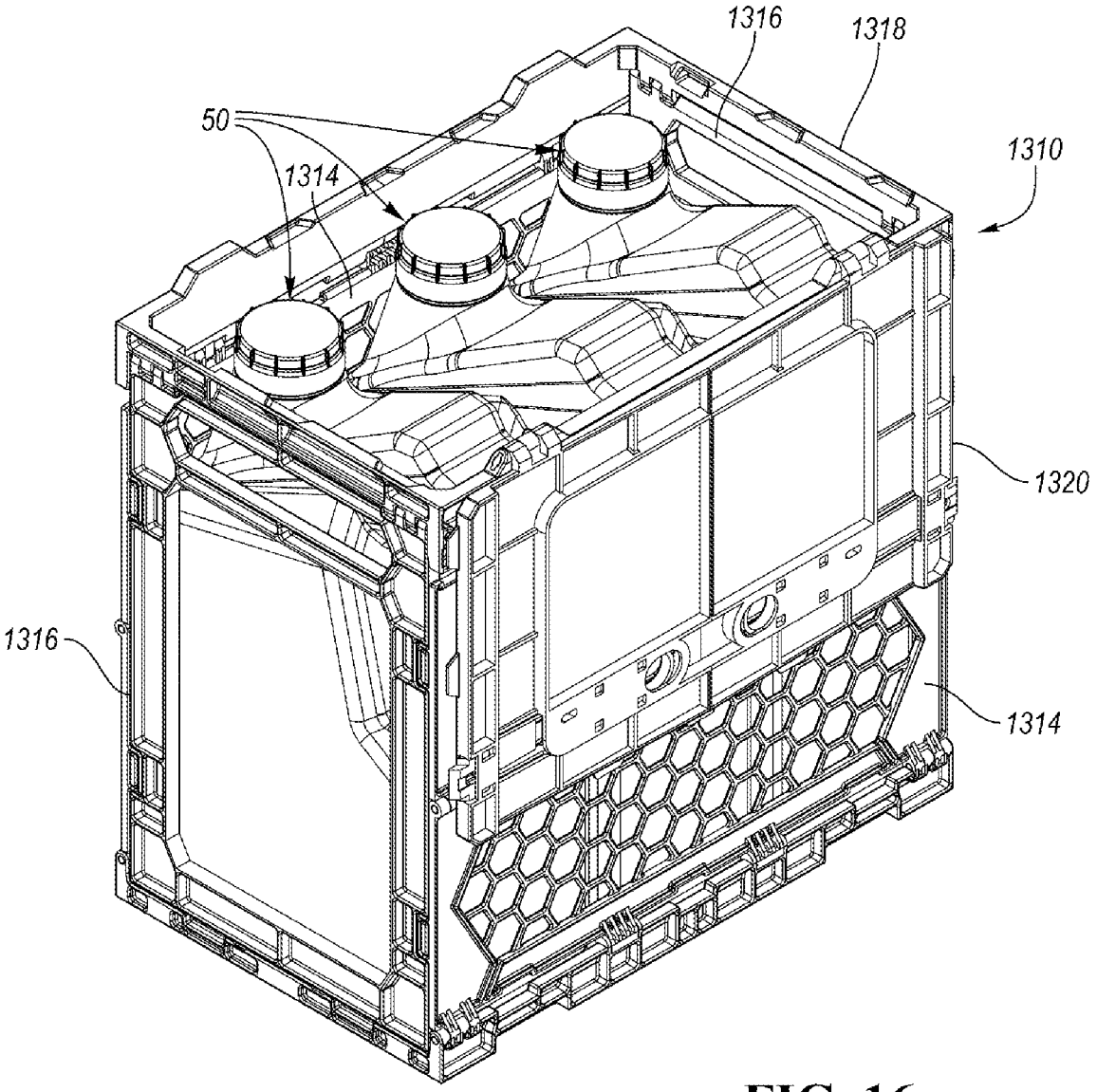
FIG. 16 is a perspective view of the container of FIG. 14 with a plurality of bottles stored therein and the lid open.

As shown in FIG. 16, the container 1310 can receive a plurality of containers, such as bottles 50 of oil. In this example, there are three bottles 50 and they are each one quart, but could be bigger or smaller and there could be more or fewer.

Figure 17:
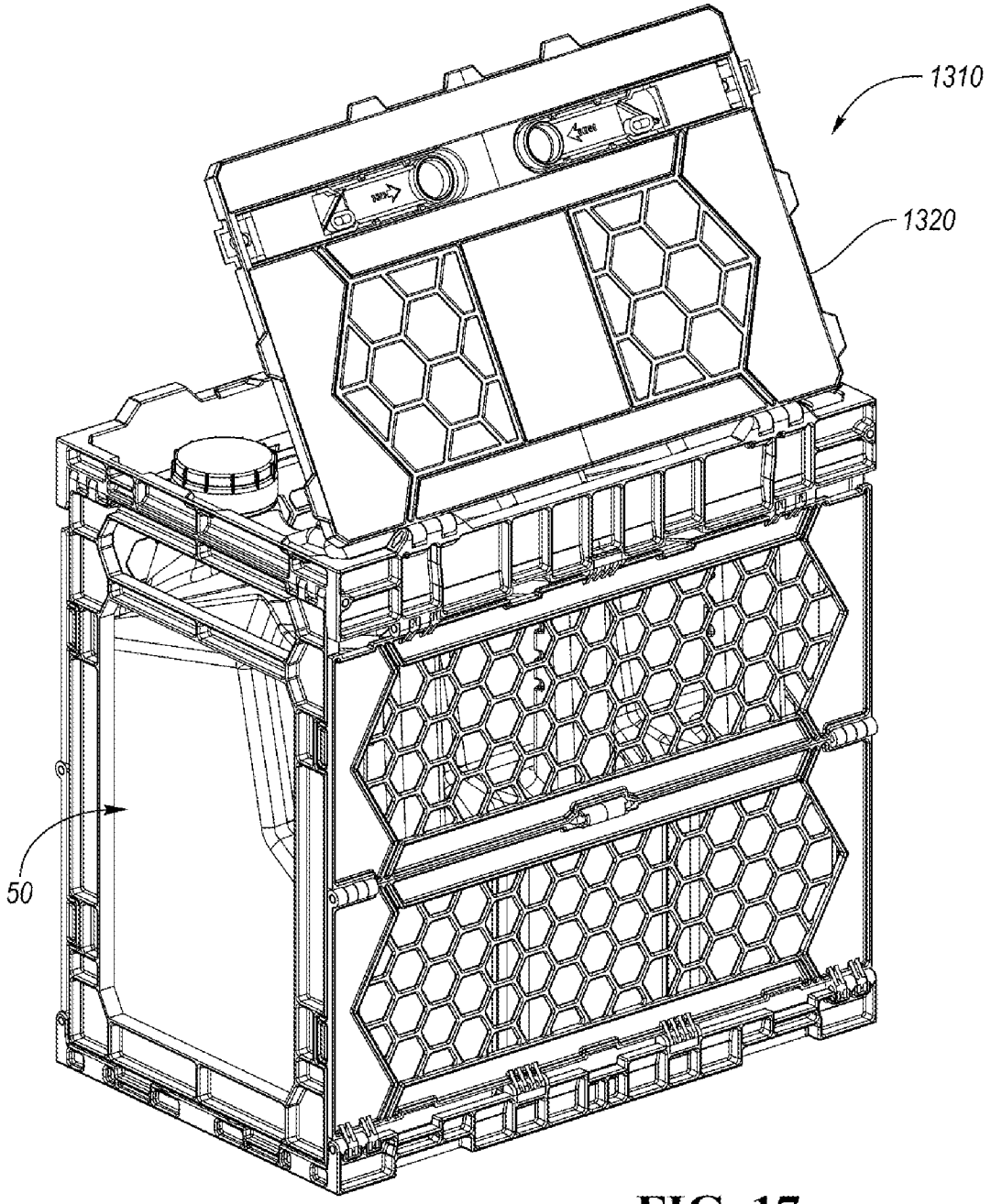
FIG. 17 shows the container and bottles of FIG. 16 with the lid being moved toward a closed position.
Figure 18:
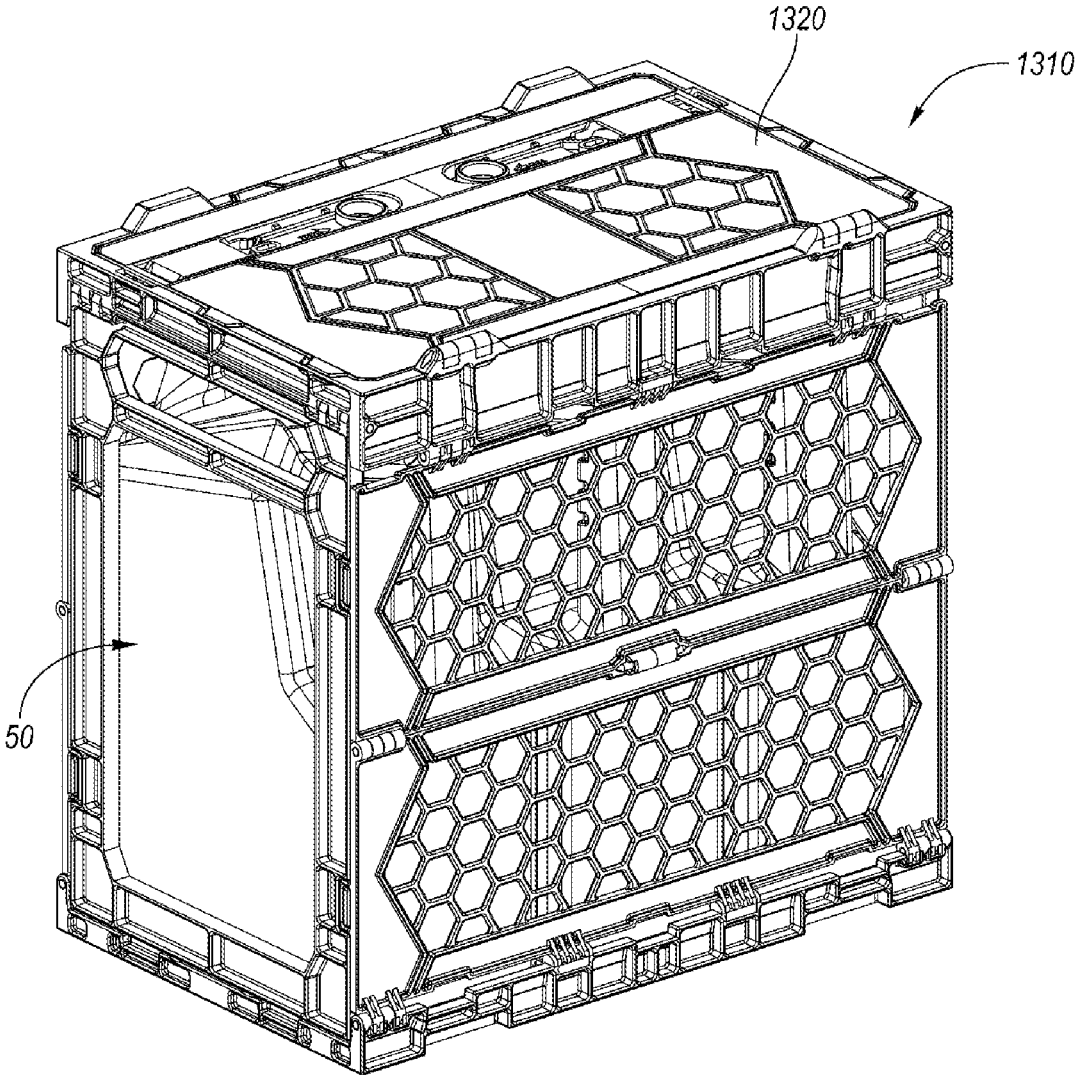
FIG. 18 shows the container and bottles of FIG. 16 with the lid closed.
Figure 19:
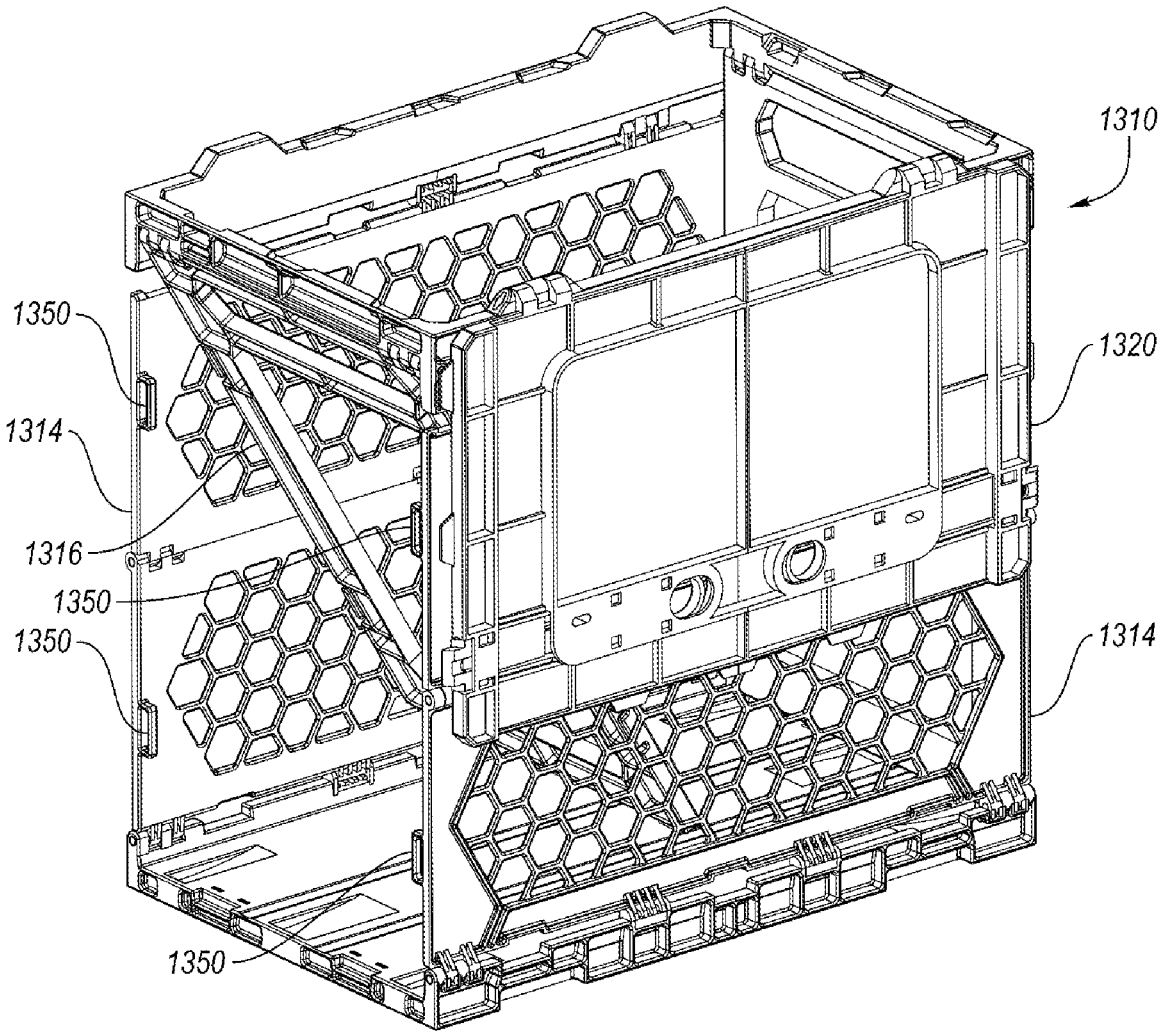
FIG. 19 shows the container of FIG. 14 in a first step of collapsing the container.

FIGS. 17 and 18 show the container 1310 and bottles 50 with the lid 1320 being closed (FIG. 17) and closed (FIG. 18).

Figure 20:
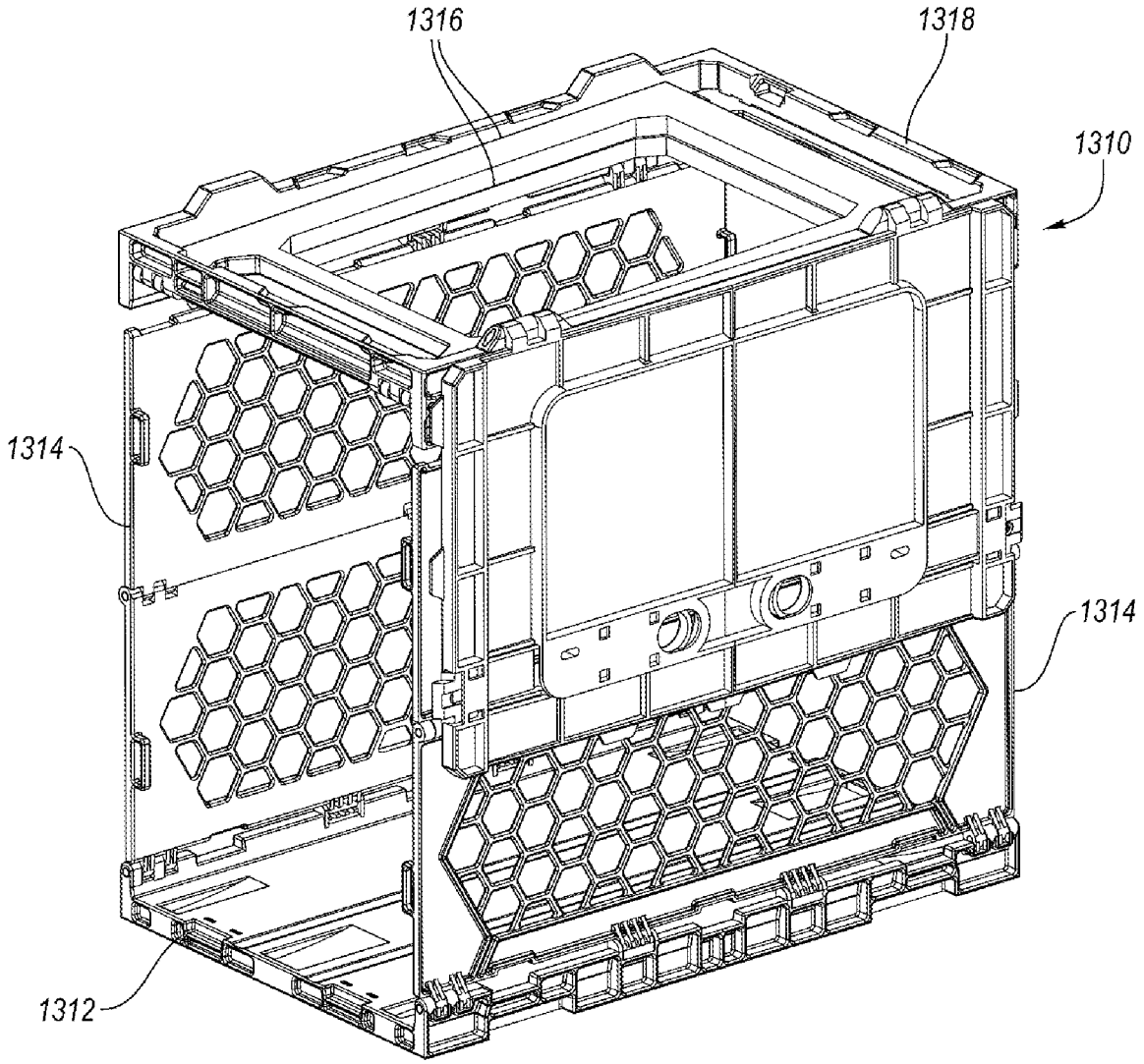
FIG. 20 shows the container of FIG. 14 in a second step of collapsing the container.
Figure 21:
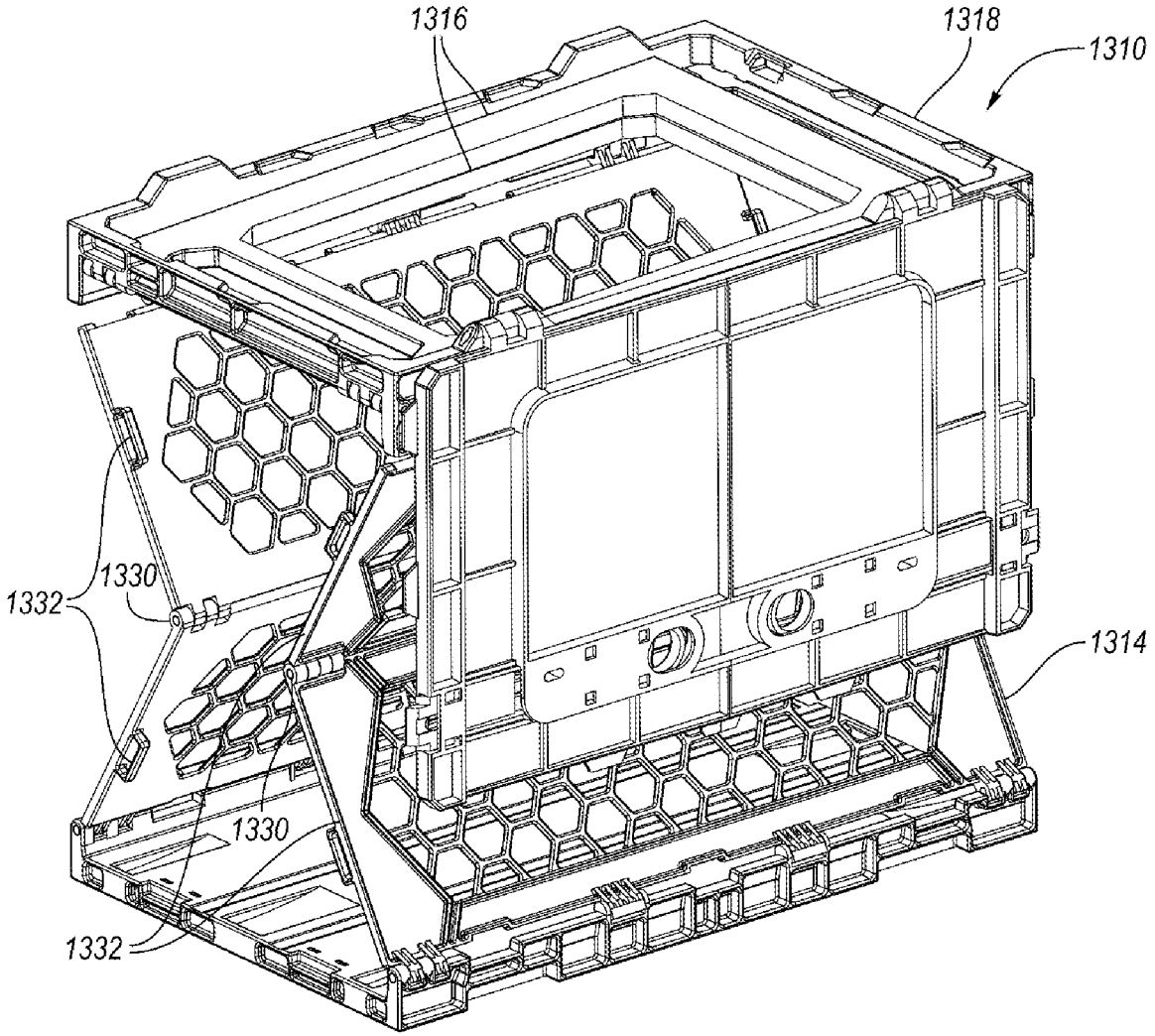
FIG. 21 shows the container of FIG. 14 in a third step of collapsing the container.
Figure 22:
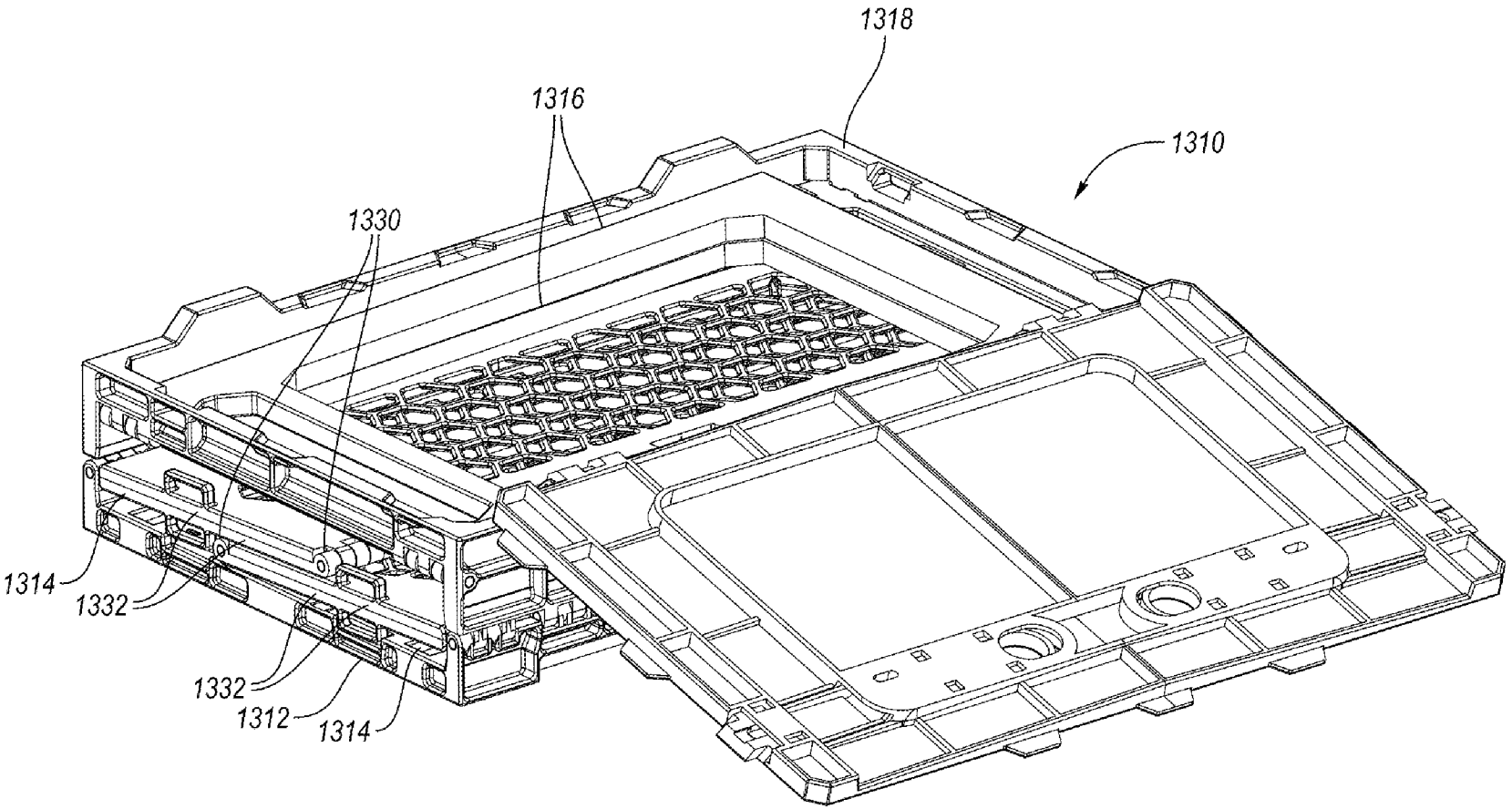
FIG. 22 shows the container of FIG. 14 collapsed with the lid open.
Figure 23:
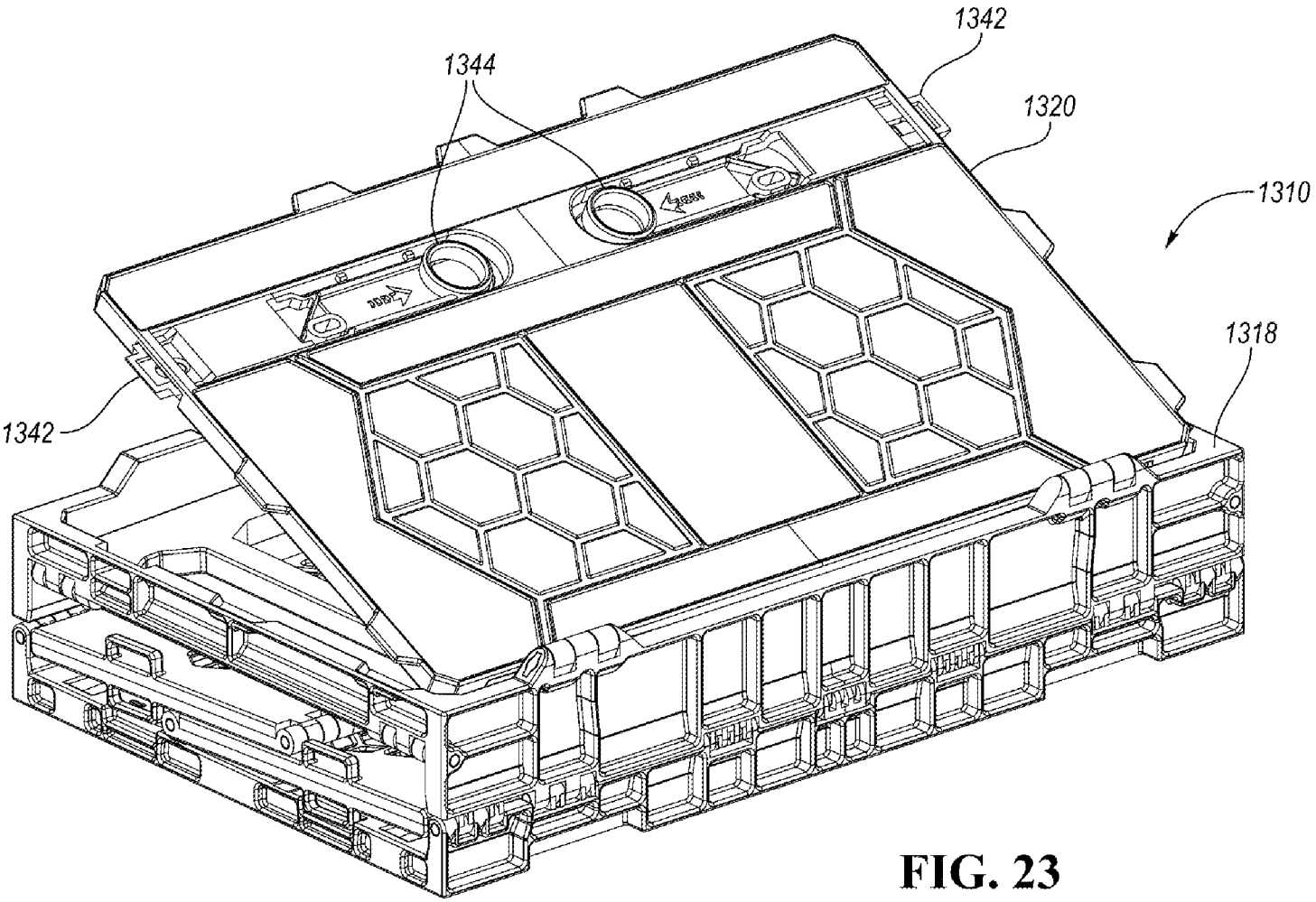
FIG. 23 shows the collapsed container of FIG. 22 with the lid partially open.

FIGS. 19 to 24 show a sequence for collapsing the crate 1310. In a first step, referring to FIG. 19, the end walls 1316 are pivoted inward away from stops 1350 projecting inward from the side walls 1314. The end walls 1316 are pivoted all the way into the upper frame 1318, as shown in FIG. 20. This permits the side walls 1314 to collapse inwardly, as shown in FIG. 21. Referring to FIG. 21, the panels 1332 of the side walls 1314 can pivot inward with the end walls 1316 in the frame 1318. The hinges 1330 move inward until the panels 1332 of the side walls 1314 are stacked on one another on the base 1312 as shown in FIG. 22. In FIG. 23, the lid 1320 is pivoted toward the closed position (which could have been done as a first step).

Figure 24:
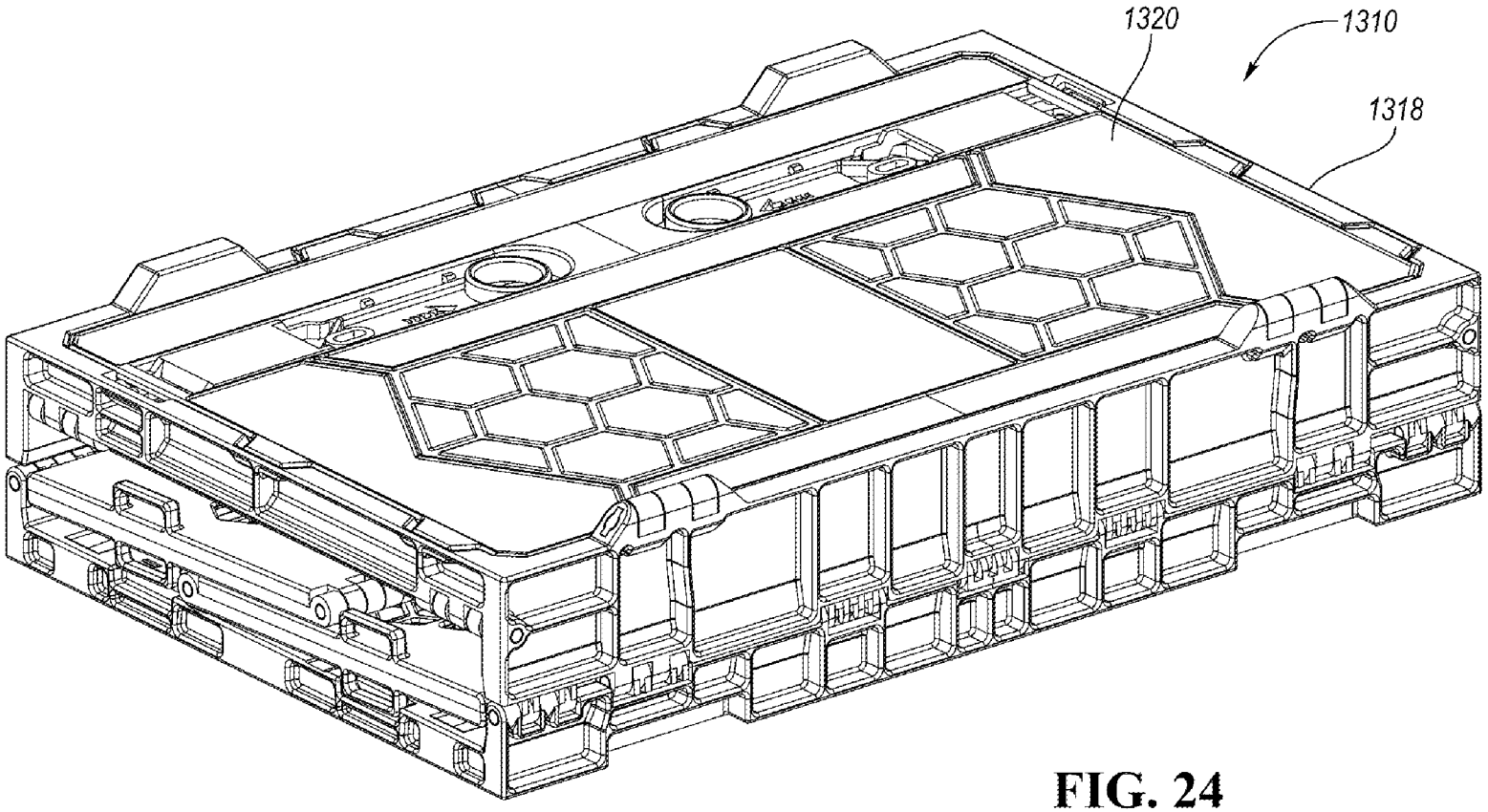
FIG. 24 shows the collapsed container of FIG. 22 with the lid closed.

FIG. 24 shows the container 1310 completely collapsed and with the lid 1320 closed. This is a compact, efficient configuration to ship and store the container 1310 when empty.

Figure 25:
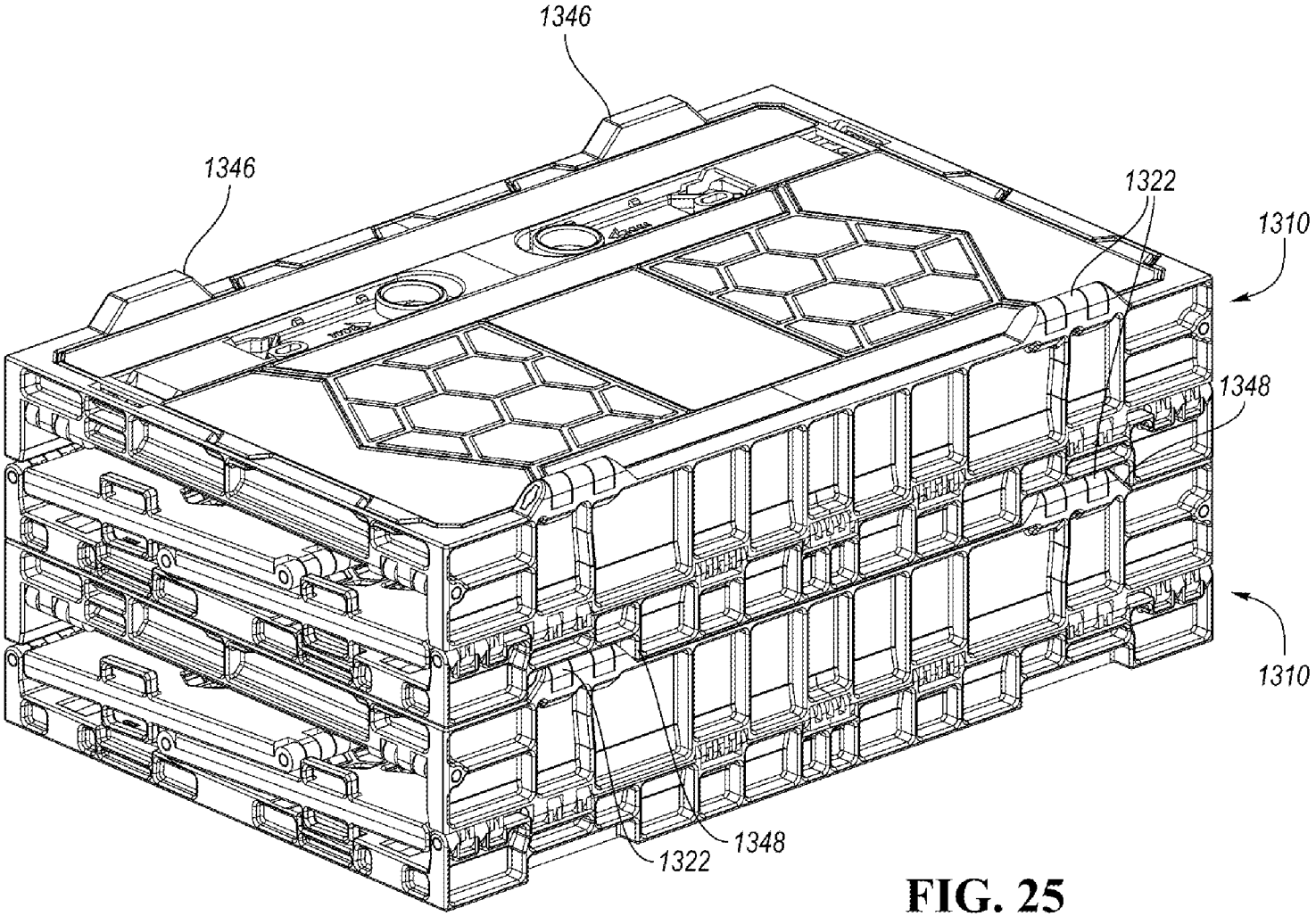
FIG. 25 shows the collapsed container of FIG. 24 with an identical container stacked thereon.

Referring to FIG. 25, a plurality of collapsed containers 1310 can be stacked. The hinges 1322 and projections 1346 of the lower container are received in the recesses 1348 of the upper container 1310 for stability. The containers 1310 could be assembled and returned to the upright, use configuration by reversing the sequence of FIGS. 18-24.

Figure 26:
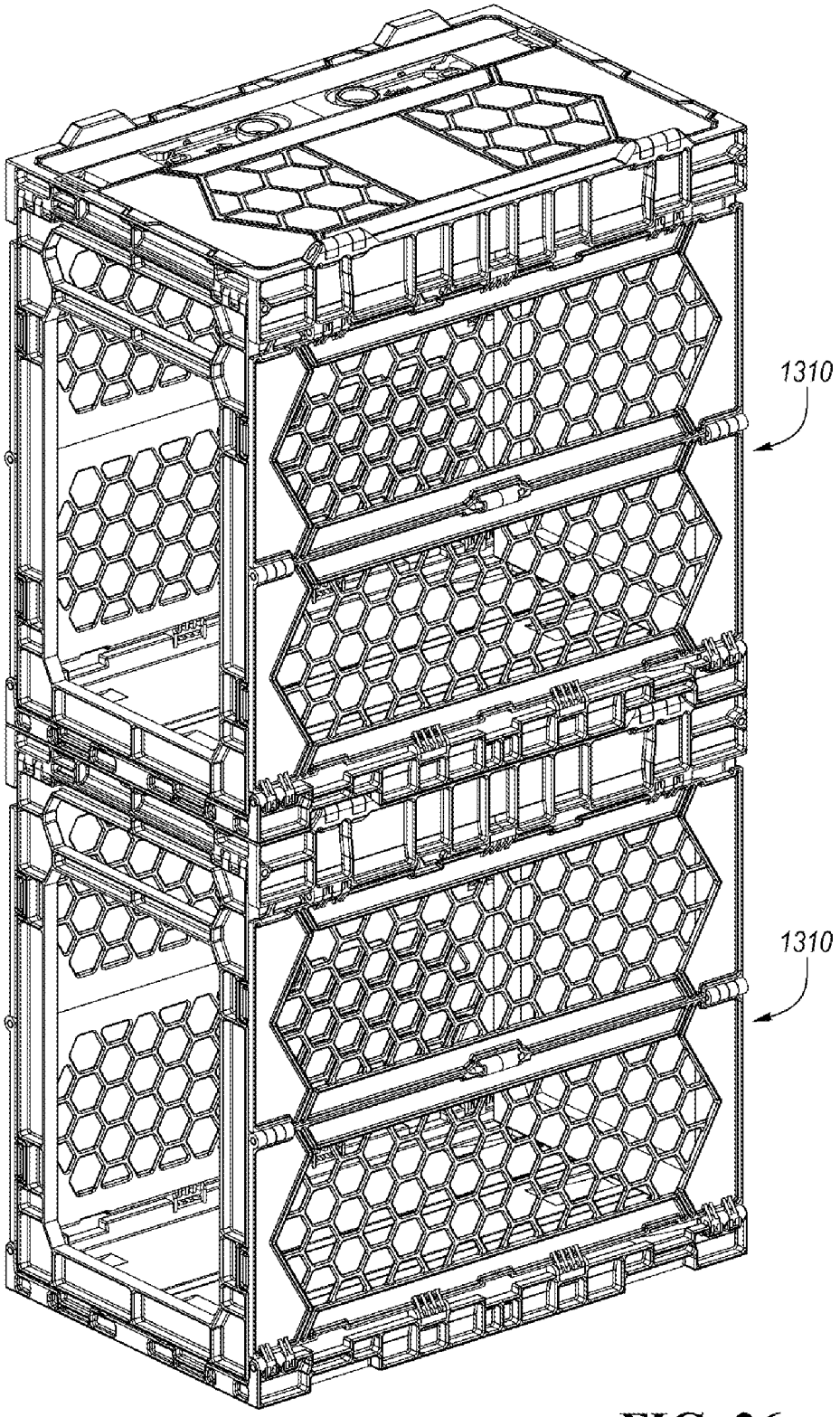
FIG. 26 shows the container of FIG. 25 stacked on an identical container.

FIG. 26 shows assembled, upright containers 1310 stacked. Again, the hinges 1322 and projections 1346 of the lower container are received in the recesses 1348 of the upper container 1310 for stability.

Figure 27:
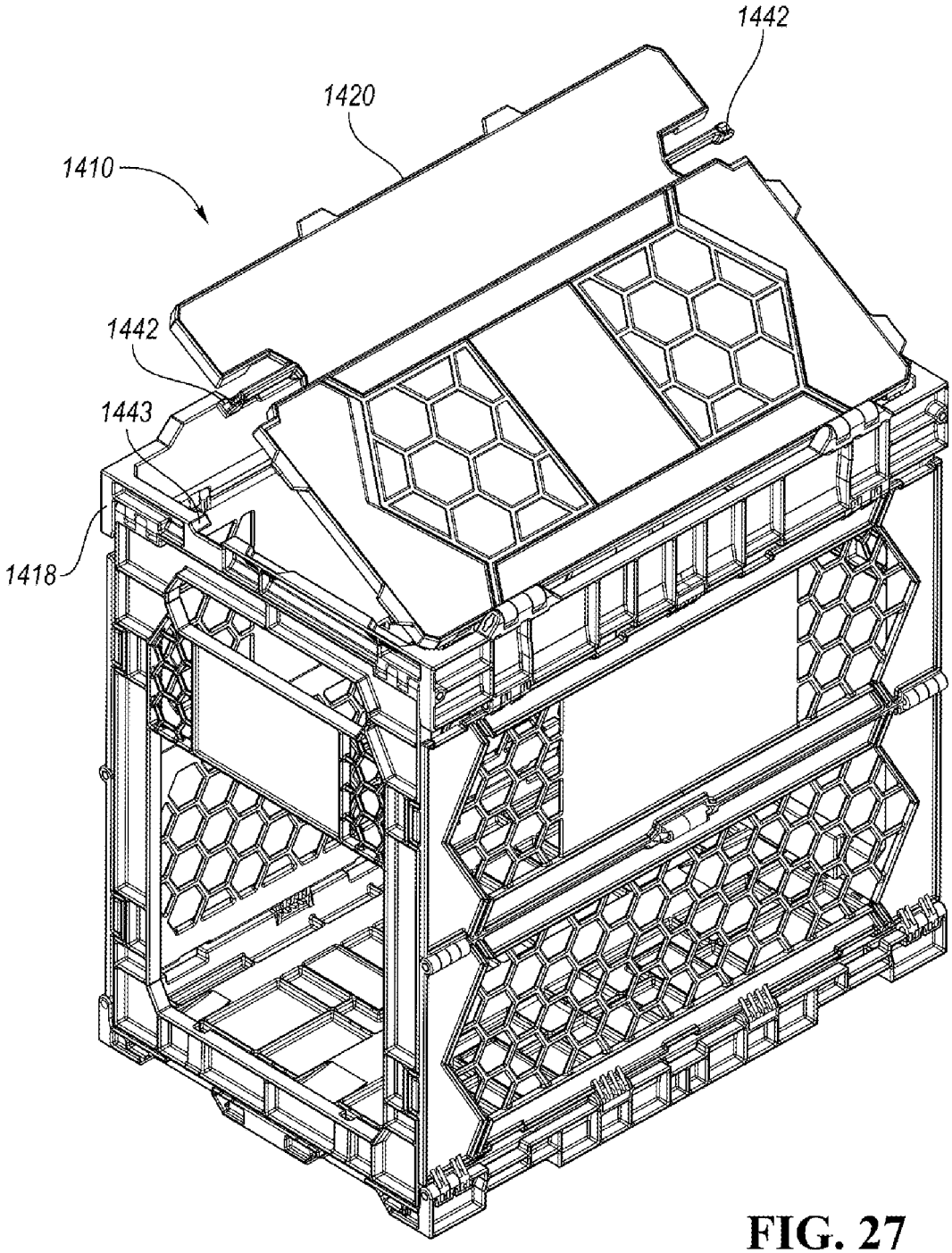
FIG. 27 shows an alternate embodiment of the container of FIG. 24 with an alternate latch for the lid.
Figure 28:
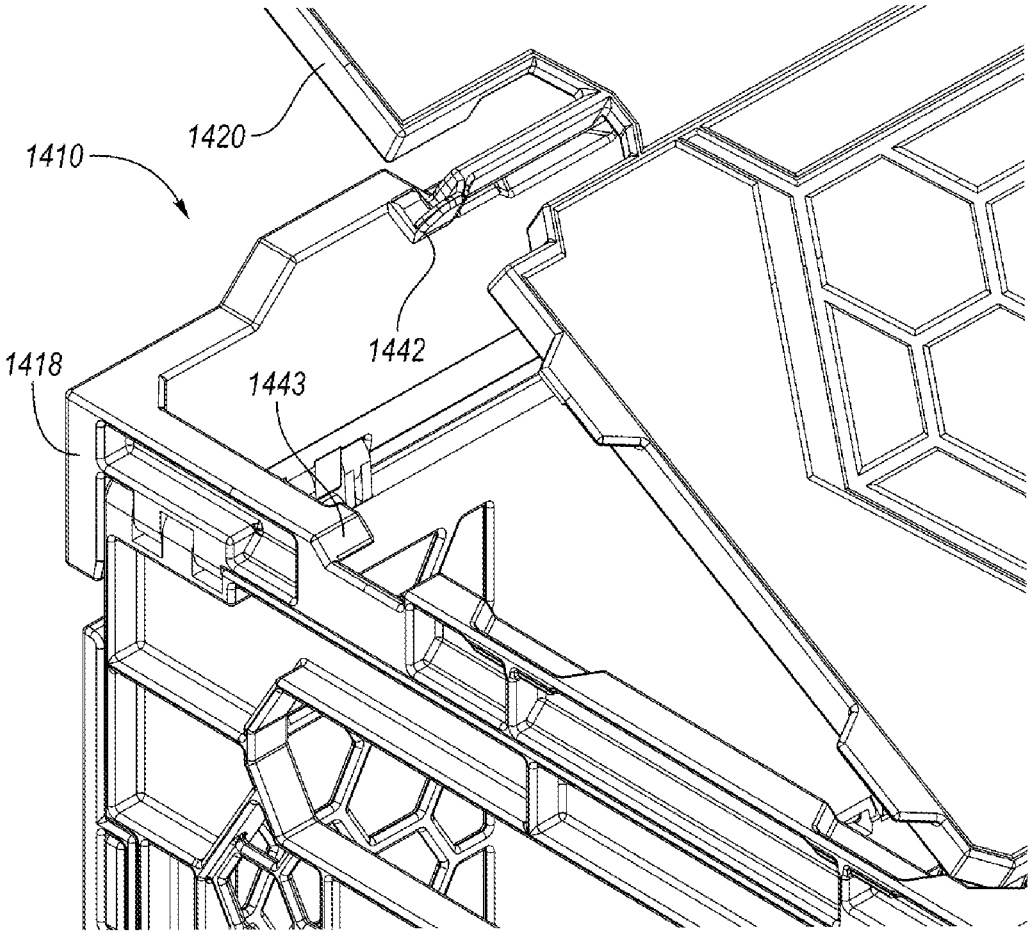
FIG. 28 is an enlarged view of the latch of FIG. 27.

FIG. 27 shows a container 1410 according to another embodiment. The container 1410 is the same as the container 1310 of FIGS. 14 to 24 except it has integral latch members 1442 projecting away from one another toward ends of the upper frame 1418. Referring to FIG. 28, the latch member 1442 projects outward into a recess formed at the periphery of the lid 1420. The latch member 1442 is configured to engage a ramped surface 1443 on the upper frame 1418, which will cause it to deflect in a plane containing the lid 1420 and to snap under the ramped surface 1443 to secure the lid 1420 closed. The latch members 1442 can then be deflected out from under the ramped surfaces 1443 to release the lid 1420 so that it can be opened again.

Figure 29:
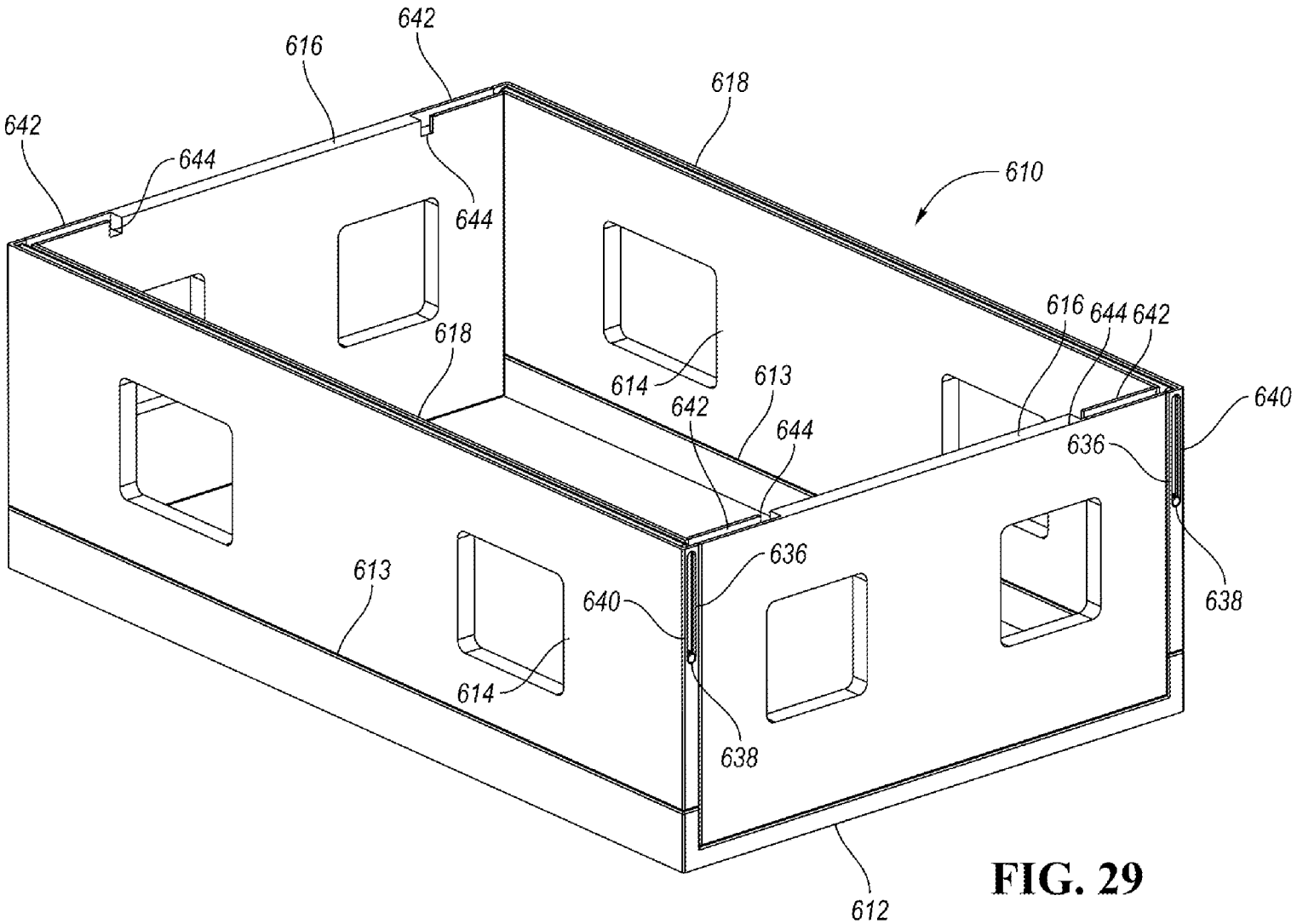
FIG. 29 is a perspective view of a container according to another embodiment.

FIG. 29 illustrates a collapsible container 610 according to another embodiment. The container 610 has a base 612 with upstanding side flanges 613. Side walls 614 are pivotably connected to upper ends of the side flanges 613. End walls 616 are pivotably connected at ends of the base 612. In FIG. 29, the side walls 614 and end walls 616 are shown in the upright position, with the end walls 616 between the side walls 614. As is known, latches (not shown) would selectively connect the end walls 616 to the side walls 614. As shown, the side walls 614 are substantially longer than the end walls 616.

The side walls 614 each include an upper cavity 618 along an upper edge thereof. A bail arm 636 is retractable into each upper cavity 618. In FIG. 29, the bail arms 636 are shown in the stored, retracted position. Each bail arm 636 includes a pair of pins 636 projecting laterally outward into a channel 640 in each end of each side wall 614. Each pin 636 can pivot and slide within the respective channel 640.

The end walls 616 each include an elongated recess 642 adjacent each side wall 614. A notch 644 spaced away from each side wall 614 leads from each recess 642 to the container interior.

Figure 30:
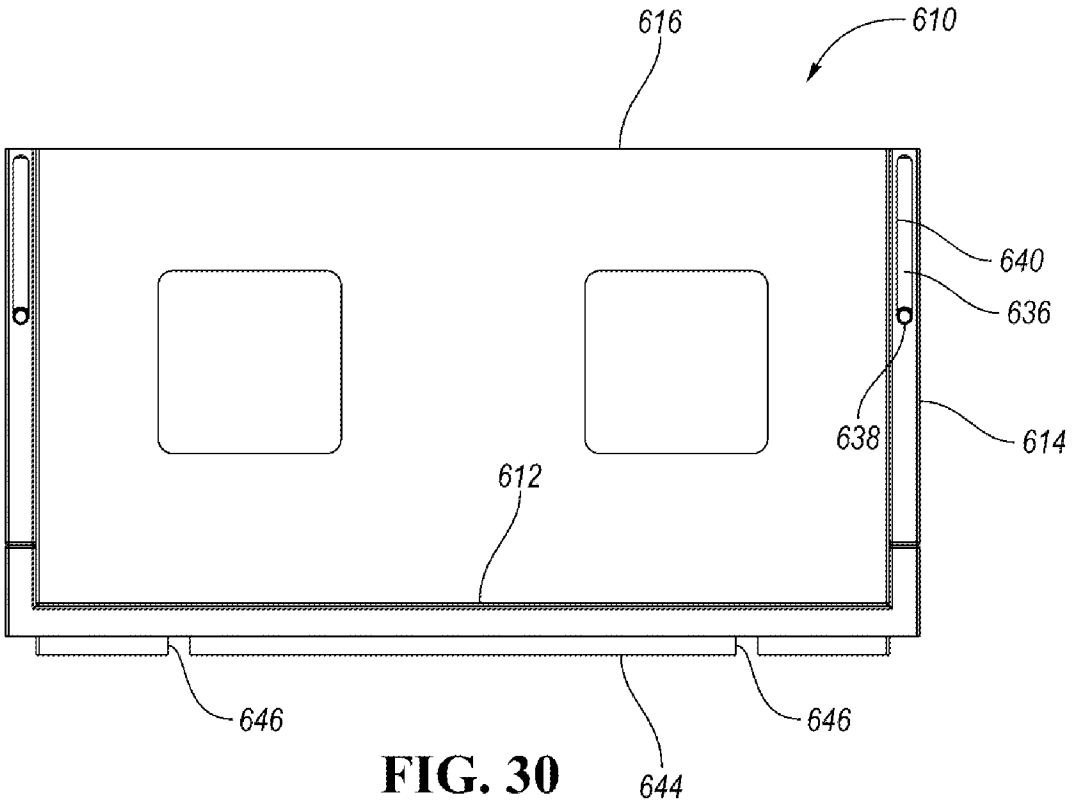
FIG. 30 is an end view of the container of FIG. 29.

FIG. 30 is an end view of the container 610 of FIG. 29. Again as shown, the bail arms 636 have pins 636 projecting laterally outward into the channel 640 in each end of each side wall 614. A drag rail 644 on the underside of the base 612 includes a pair of notches 646 for receiving a portion of the bail arms 636 of a container 610 stacked therebelow, as will be explained later below.

Figure 31:
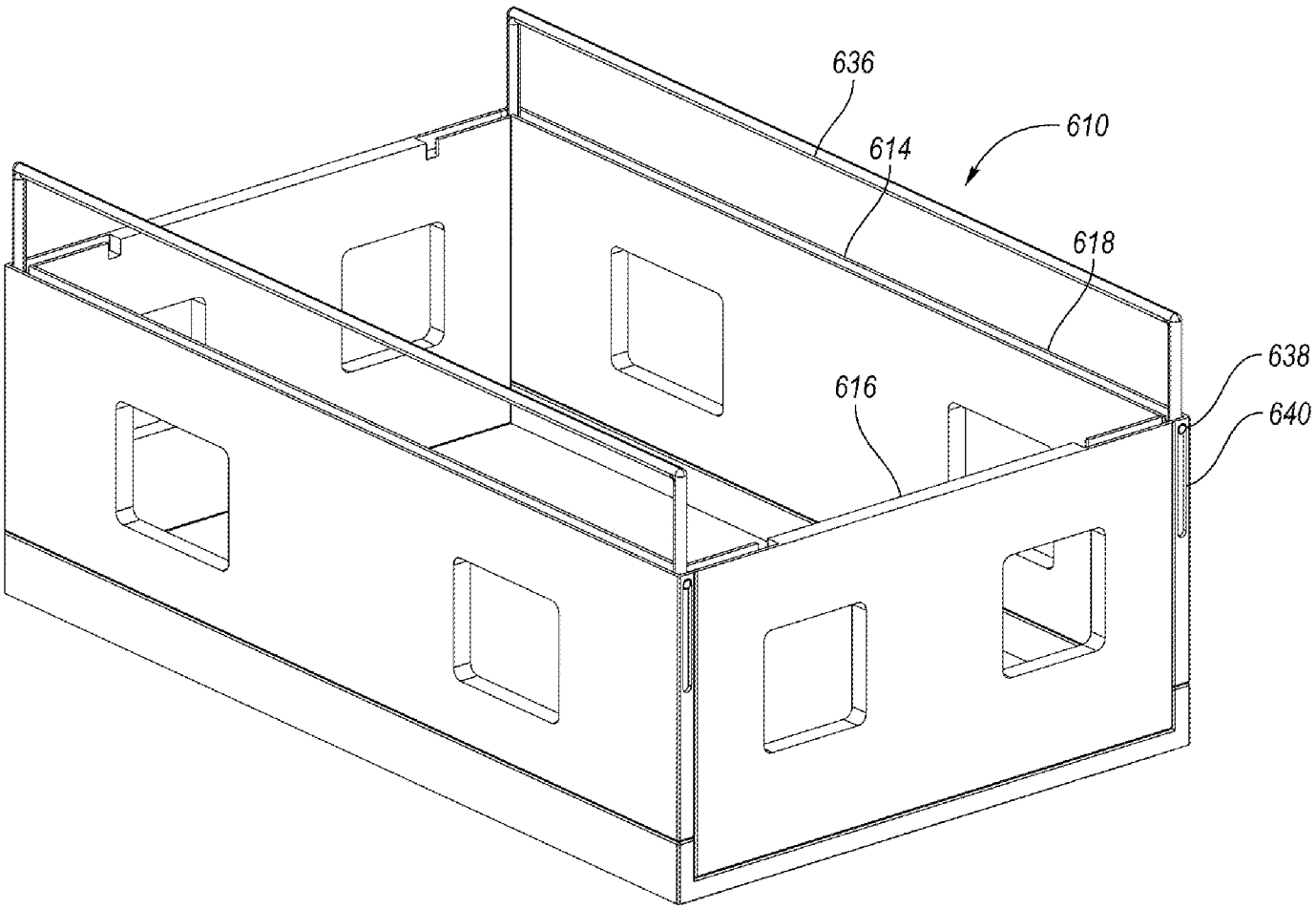
FIG. 31 shows the container of FIG. 29 with the bail arms partially deployed.
Figure 32:
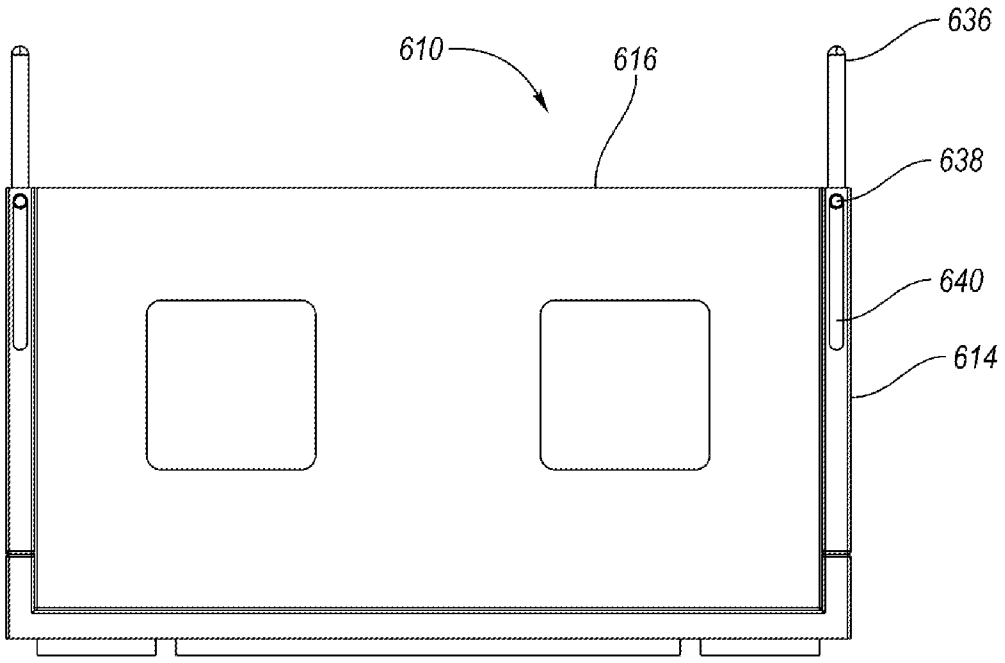
FIG. 32 is an end view of the container of FIG. 31.

In FIG. 31, the bail arms 636 are shown having been slid upward. The pins 638 slide upward in the channels 640 in the side walls 614. The bail arms 636 are each U-shaped, including a pair of parallel arms and a cross-beam extending across outer ends of the parallel arms. Lower ends of the parallel arms have the pins 638 extending therefrom. FIG. 32 is an end view of the container of FIG. 31.

Figure 33:
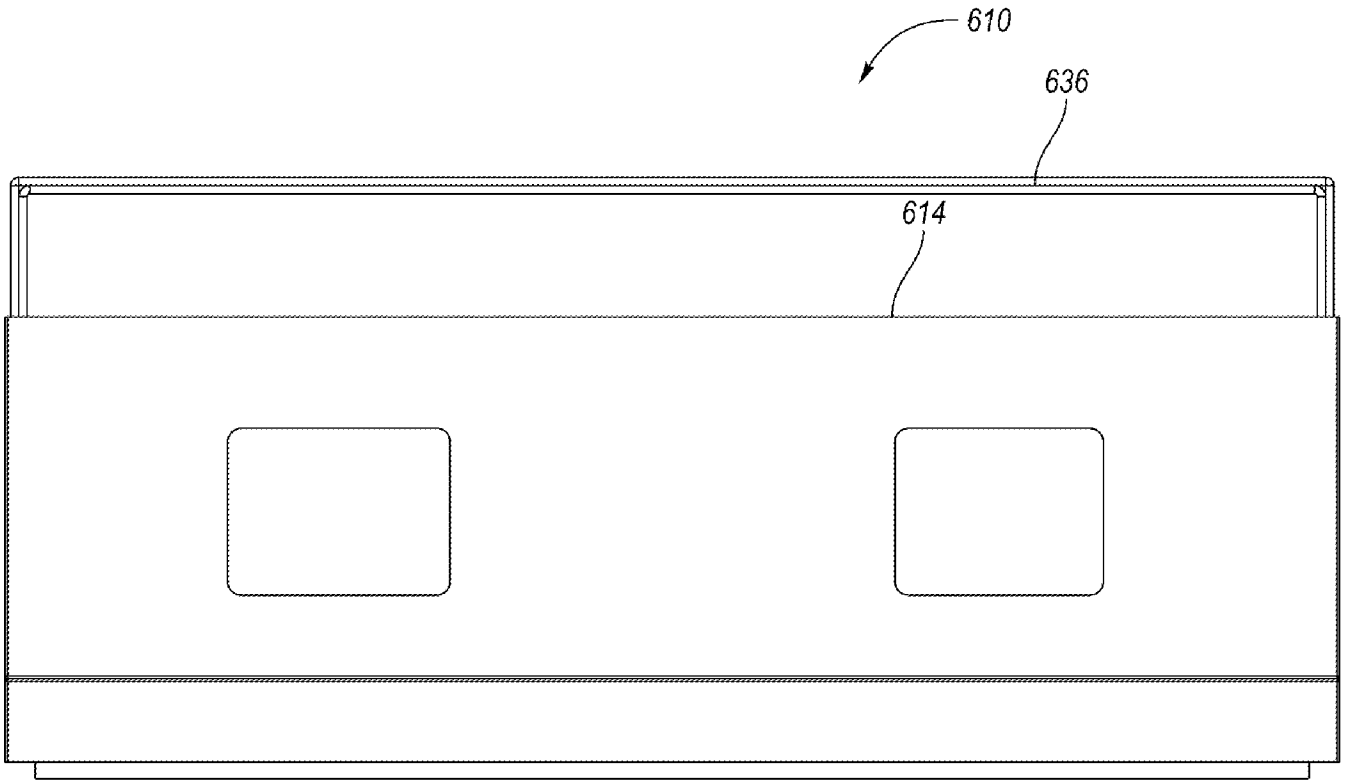
FIG. 33 is a side view of the container of FIG. 31.

FIG. 33 is a side view of the container 610 of FIG. 31.

Figure 34:
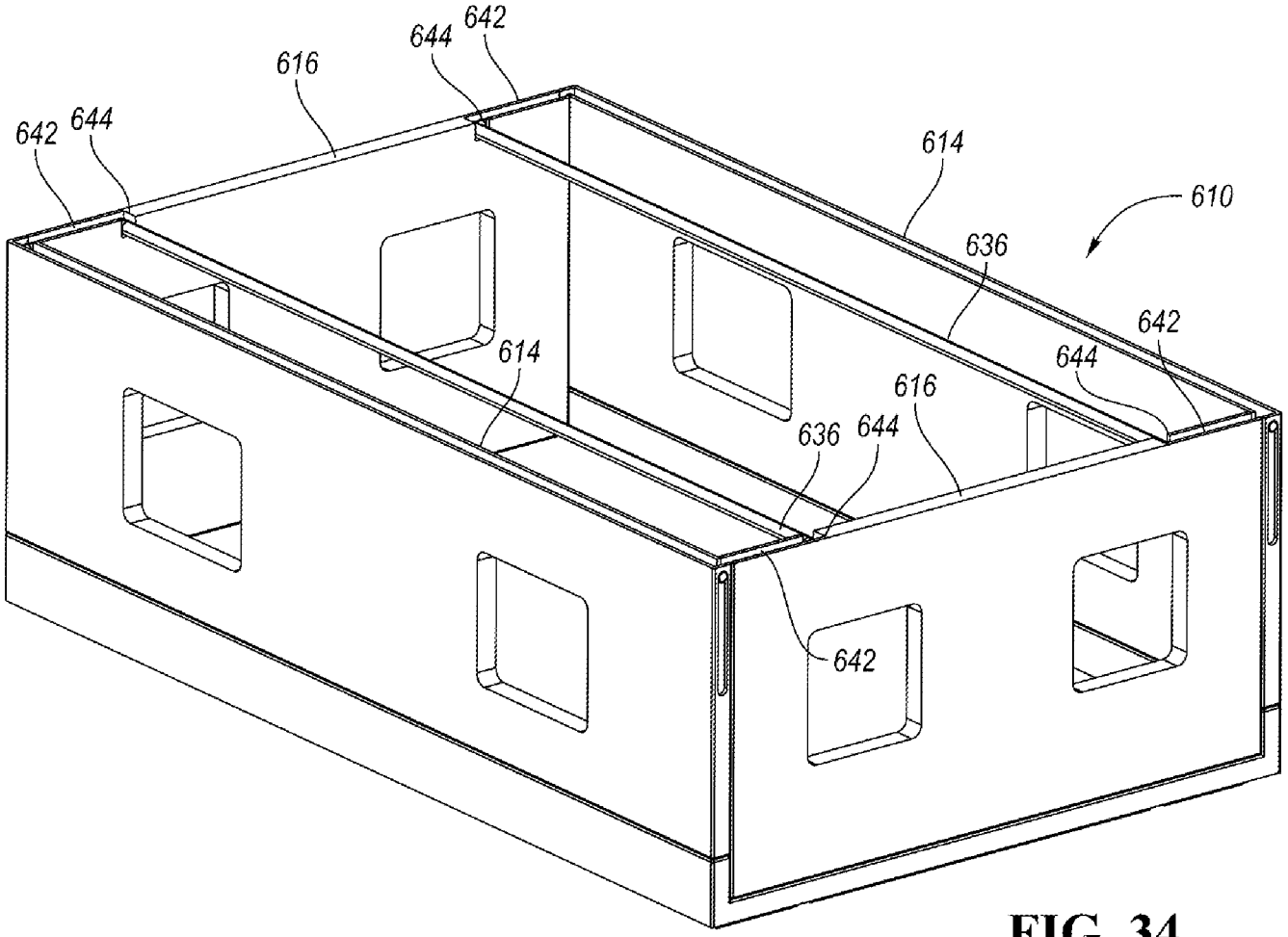
FIG. 34 shows the container of FIG. 29 with the bail arms in the deployed position.

FIG. 34 shows the container 610 of FIG. 31 with the bail arms 636 further pivoted to the deployed position. The parallel arms of the bail arms 636 are partially received in the recesses 642 in the end walls 616. The cross beams are received in the notches 644. The bail arms 636 each extend across the container 610 from one end wall 616 to the other. The bail arms 636 would be selectively locked into this position either by detents or latches.

In use, in this position, bottles (or other items) within the container 610 would be retained in the container 610 interior by the bail arms 636. Therefore, if the container 610 were tipped or dropped, the bottles or other items would be retained in the container 610. Upon releasing the latches or overcoming the detents, the bail arms 636 could be pivoted outwardly and then slid back into the cavities 618 in the side walls 614 as shown n FIG. 29. The bottles or other items could then be removed from the container 610.

Figure 35:
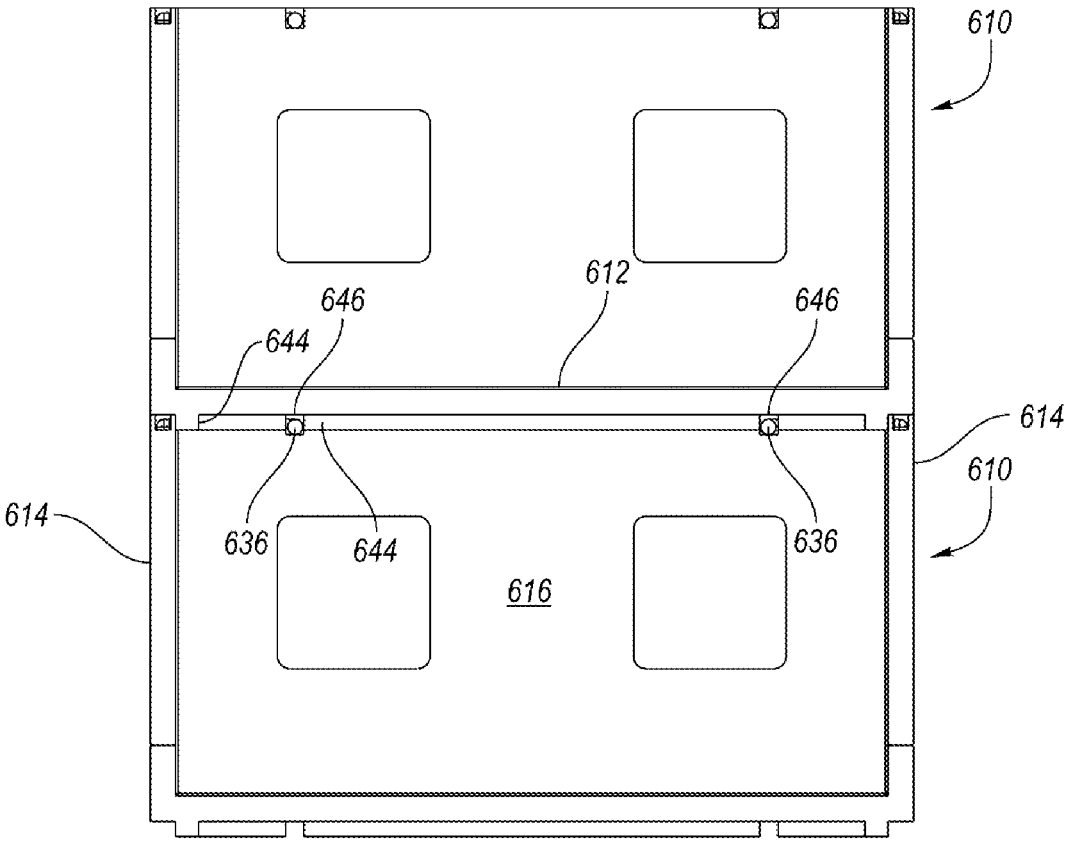
FIG. 35 is an end view of the container of FIG. 34 with an identical container stacked thereon.

FIG. 35 is an end view of the container 610 of FIG. 34 with an identical container 610 stacked thereon. The bail arms 636 of the lower container 610 are received in the notches 646 through the drag rail 644 of the upper container 610. The drag rail 644 of the upper container 610 is received between the side walls 614 and between the end walls 616 of the lower container 610. The base 612 of the upper container 610 is stacked on the side walls 614 and end walls 616 of the lower container 610.

Figure 36:
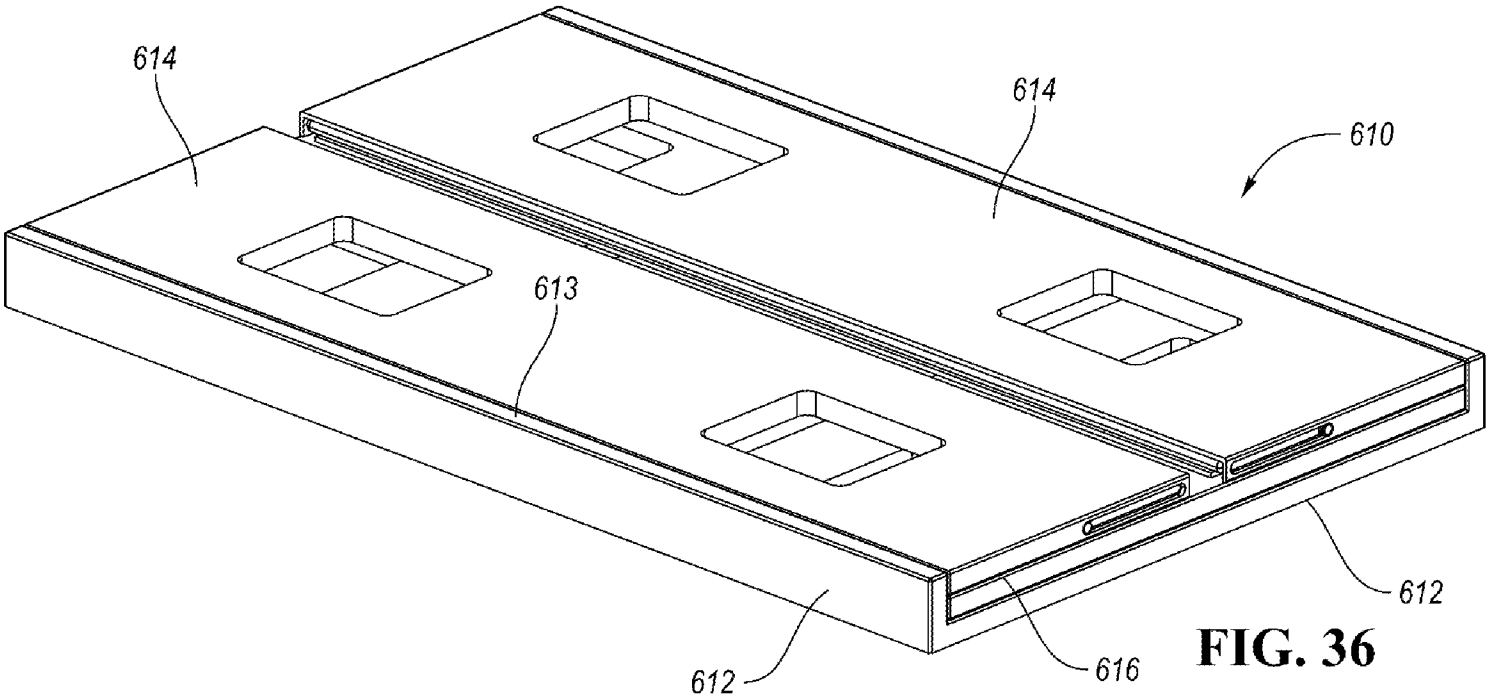
FIG. 36 shows the container of FIG. 29 in a collapsed position.
Figure 37:
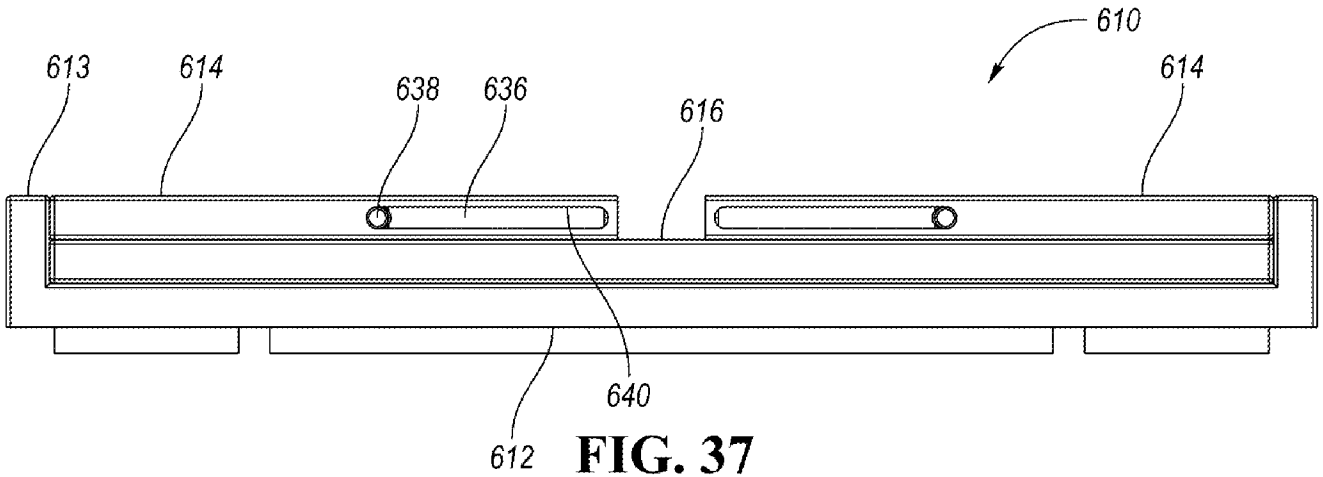
FIG. 37 is an end view of the container of FIG. 36.

As shown in FIG. 36, when empty the container 610 can be reconfigured to the collapsed position. The side walls 614 and end walls 616 are pivoted down onto the base 612. More specifically, the side walls 614 are pivoted down onto the end walls 616. FIG. 37 is an end view of the collapsed container 610 of FIG. 36. Alternatively, the bail arms 636 could be mounted in the end wall 616.

Figure 38:
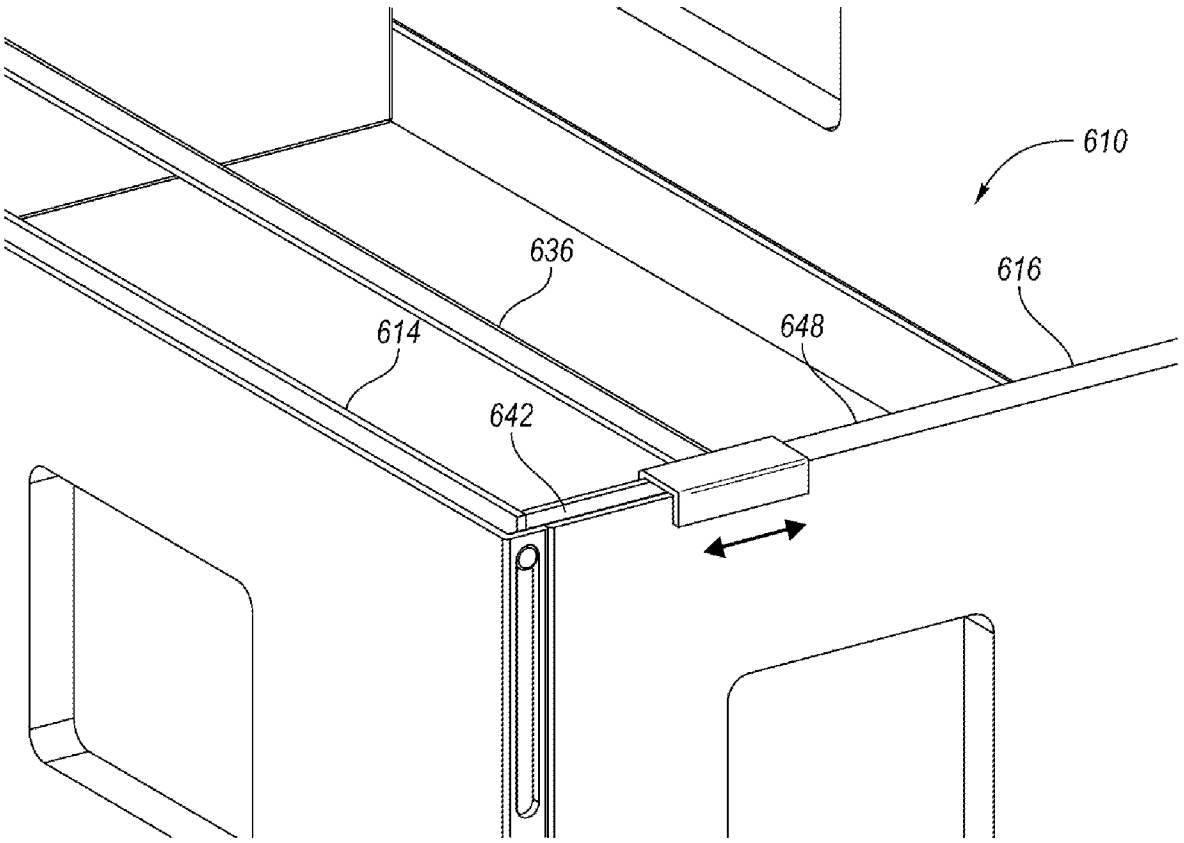
FIG. 38 shows a corner of the container of FIG. 29 with a latch.

FIG. 38 shows one corner of the container 610 with a sliding latch 648 slidably mounted to an upper edge of the end wall 616. The latch 648 can be slid to the locked position shown, wherein the latch 648 extends partially over the recess 642 in which the bail arm 636 is partially received. Similar latches 648 would be mounted adjacent each of the four recesses 642 to selectively lock the bail arms 636 in the deployed position, thereby retaining bottles or other items in the container 610.

Figure 39:
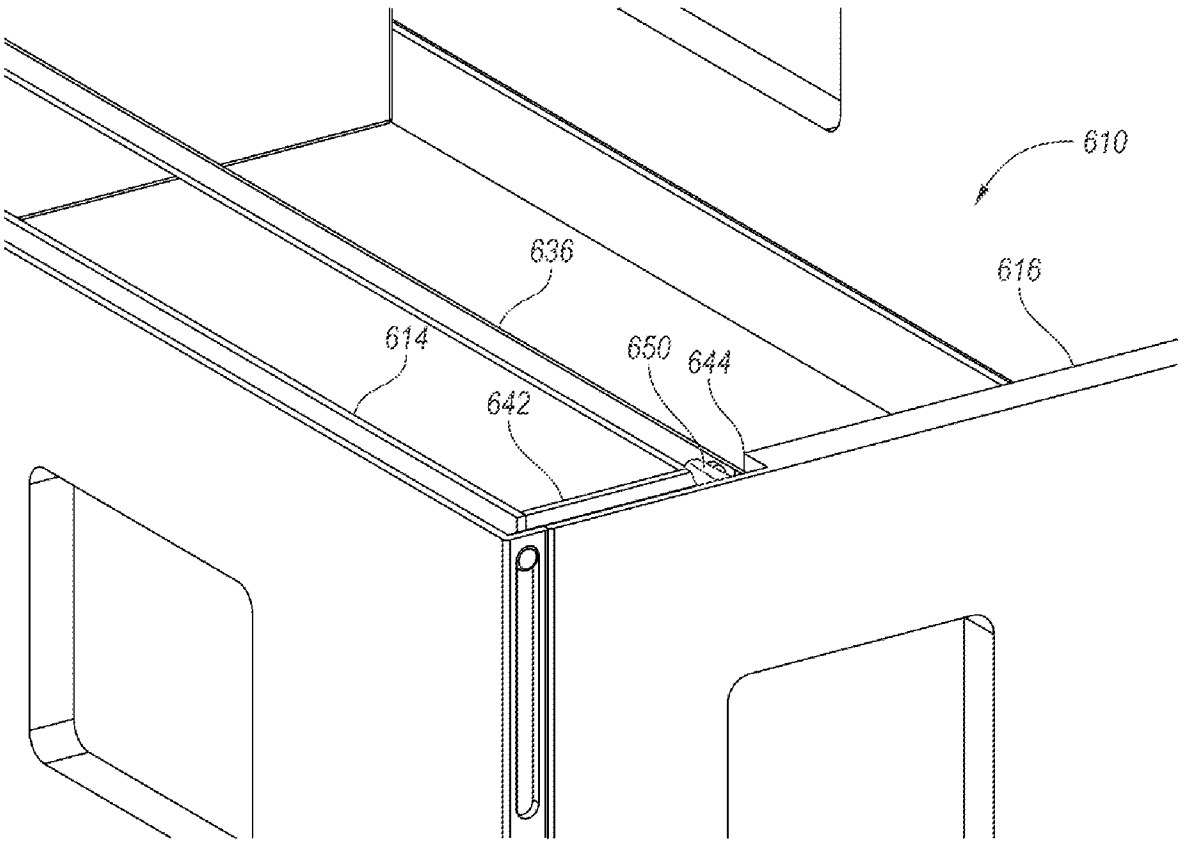
FIG. 39 shows the corner of the container of FIG. 29 with a detent.

FIG. 39 shows one corner of the container 610 with a detent 650 formed adjacent the notch 644 leading to the recess 642. The detent 650 projects into the notch 644 over the bail arm 636 in the deployed position. The bail arm 636 must be snapped past the detent 650 to move it to the deployed position. The detent 650 retains the bail arm 636 in the deployed position and retains bottles or other items in the container 610.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A nestable container in combination with a plurality of bottles, the combination comprising:

the nestable container including a base and a plurality of walls extending upward from the base, each of the plurality of walls including an upper portion and a lower portion, the plurality of walls including a pair of opposed side walls and a pair of opposed end walls, wherein the upper portion projects outwardly relative to the lower portion, such that the lower portion of the nestable container can be received in the upper portion of an identical nestable container the nestable container further including at least one bail arm pivotably mounted to the upper portion, the at least one bail arm pivotable between a deployed position extending into an interior of the container and a retracted position adjacent an interior surface of the upper portion, wherein the at least one bail arm is lockable in the deployed position to prevent movement of the at least one bail arm from the deployed position to the retracted position; and a plurality of bottles resting on the base, the plurality of bottles abutting the pair of opposed side walls and the pair of opposed end walls, wherein each the plurality of bottles is between the base and the at least one bail arm in the deployed position, and wherein the at least one bail arm is lockable in the deployed position to retain each of the plurality bottles in the nestable container.

2. The nestable container of claim 1 wherein the lower portion of one of the plurality of walls includes a plurality of spaced-apart vertical slats.

3. The nestable container of claim 1 wherein the at least one bail arm includes a pair of bail arms each pivotably secured to and receivable in a different one of the plurality of walls.

4. The nestable container of claim 1 wherein the at least one bail arm is pivotably and slidably connected to the walls.

5. The nestable container and plurality of bottles of claim 1 wherein the bottles each include a shoulder leading to a neck and a bottle cap secured to the neck and wherein the at least one bail arm is in the deployed position, and wherein the bail arm is above the shoulders but below the bottle caps.

6. The nestable container and plurality of bottles of claim 5 wherein the at least one bail arm includes a pair of arms pivotably connected at lower ends to the plurality of walls and a cross-beam connecting outer ends of the pair of arms to one another and wherein the cross-beam of the at least one bail arm is above the shoulders but below the bottle caps and the at least one bail arm is in the deployed position with the cross-beam above the shoulders but below the bottle caps.

7. The nestable container of claim 1 wherein the at least one bail arm includes a first bail arm and the plurality of walls includes a first wall, wherein the first bail arm is pivotably connected to the first wall.

8. The nestable container of claim 7, wherein the first bail arm includes a pair of arms pivotably connected at lower ends to the plurality of walls and a cross-beam connecting outer ends of the pair of arms to one another.

9. A nestable container comprising:

a base;

a plurality of walls extending upward from the base, each of the plurality of walls including an upper portion and a lower portion, wherein the lower portion of one of the plurality of walls includes a plurality of spaced-apart vertical slats, wherein the upper portion projects outwardly relative to the lower portion, wherein the vertical slats are configured to permit slats of an identical container to be received therebetween when the identical container is in a first orientation relative to the nestable container; and at least one bail arm pivotably mounted to the upper portion, the at least one bail arm pivotable between a deployed position extending into an interior of the container and a retracted position adjacent an interior surface of the upper portion, wherein the at least one bail arm is lockable in the deployed position.

10. The nestable container of claim 9 wherein the at least one bail arm includes a pair of bail arms each pivotably secured to and receivable in a different one of the plurality of walls.

11. The nestable container of claim 9 wherein the at least one bail arm is pivotably and slidably connected to the walls.

12. The nestable container of claim 9 in combination with a plurality of bottles resting on the base and abutting each of the plurality of walls, wherein each of the plurality of bottles is between the base and the at least one bail arm in the deployed position, and wherein the at least one bail arm is lockable in the deployed position to retain each of the plurality of bottles in the nestable container.

13. A nestable container in combination with a plurality of bottles, the combination comprising:

the nestable container including a base and a plurality of walls extending upward from the base, each of the plurality of walls including an upper portion and a lower portion, wherein the upper portion projects outwardly relative to the lower portion, wherein the lower portion permits a lower portion of an identical container to be received therebetween when the identical container is in a first orientation relative to the nestable container; the nestable container further including a first bail arm including a pair of arms pivotably mounted to the upper portion of a first wall of the plurality of walls, the first bail arm pivotable between a deployed position extending into an interior of the container and a retracted position adjacent an interior surface of the upper portion of the first wall;

the nestable container further including a second bail arm pivotably mounted to the upper portion of a second wall of the plurality of walls, wherein the first bail arm is receivable in a first recess in the first wall and the second bail arm is receivable in a second recess in a second wall of the plurality of walls, wherein the first and second walls each includes a detent that locks the respective bail arm in the deployed position and resists movement of the respective bail arm from the deployed position to the retracted position; and the plurality of bottles resting on the base, wherein the plurality of bottles are between the base and the first and second bail arms in the deployed position.

14. The combination of the nestable container and plurality of bottles of claim 13 wherein the first and second walls each includes a handle opening.

15. The combination of the nestable container and plurality of bottles of claim 14 wherein the first and second bail arms each include a pair of arms pivotably connected at lower ends to the plurality of walls and a cross-beam connecting outer ends of the pair of arms to one another.

16. The combination of the nestable container and plurality of bottles of claim 15 wherein the handle openings are each between one of the pair of arms when the two bail arms are in the retracted position.

17. The nestable container of claim 13 wherein first wall includes a detent that is configured to lock the first bail arm in the deployed position.

18. The nestable container of claim 13 wherein the lower portion includes a plurality of spaced-apart vertical slats.

19. The nestable container of claim 13 wherein the first bail arm includes a cross-beam connecting outer ends of the pair of arms to one another and wherein the cross-beam is parallel to the first wall in the deployed position and the retracted position.

20. A nestable container comprising:

a base;

a plurality of walls extending upward from the base, each of the plurality of walls including an upper portion and a lower portion, wherein the upper portion projects outwardly relative to the lower portion, such that the lower portion of the nestable container can be received in the upper portion of an identical nestable container; and at least one bail arm pivotably mounted to the upper portion, the at least one bail arm pivotable between a deployed position extending into an interior of the container and a retracted position adjacent an interior surface of the upper portion, wherein the at least one bail arm is lockable in the deployed position to prevent movement of the at least one bail arm from the deployed position to the retracted position, wherein the at least one bail arm includes a first bail arm and the plurality of walls includes a first wall, wherein the first bail arm is pivotably connected to the first wall, wherein the first bail arm includes a pair of arms pivotably connected at lower ends to the plurality of walls and a cross-beam connecting outer ends of the pair of arms to one another, wherein the first wall includes recesses for receiving the pair of arms and the cross-beam of the first bail arm in the retracted position.

21. The nestable container of claim 20 wherein the first wall includes a detent configured to retain the first bail arm in the deployed position.

22. The nestable container of claim 21 wherein the first wall includes a detent configured to retain the first bail arm in the deployed position.

* * * * *